US009944039B2

(12) United States Patent
Suzuki et al.

(10) Patent No.: US 9,944,039 B2
(45) Date of Patent: Apr. 17, 2018

(54) CORRUGATED PAPERBOARD SHEET MANUFACTURING APPARATUS

(71) Applicant: KABUSHIKI KAISHA ISOWA, Nagoya-shi, Aichi (JP)

(72) Inventors: Michio Suzuki, Komaki (JP); Yusuke Tozuka, Nagoya (JP); Satoru Tsuchiya, Kasugai (JP); Masufumi Sonoda, Nagoya (JP)

(73) Assignee: KABUSHIKI KAISHA ISOWA, Nagoya-Shi, Aichi (JP)

( * ) Notice: Subject to any disclaimer, the term of this patent is extended or adjusted under 35 U.S.C. 154(b) by 111 days.

(21) Appl. No.: 15/085,040

(22) Filed: Mar. 30, 2016

(65) Prior Publication Data

US 2016/0361886 A1 Dec. 15, 2016

(30) Foreign Application Priority Data

Jun. 9, 2015 (JP) ..... 2015-116876
Jun. 9, 2015 (JP) ..... 2015-116877
Jun. 9, 2015 (JP) ..... 2015-116878

(51) Int. Cl.

| | |
|---|---|
| ***B31F 1/28*** | (2006.01) |
| ***B41J 11/70*** | (2006.01) |
| ***B41J 13/00*** | (2006.01) |
| ***B41J 25/308*** | (2006.01) |

(52) U.S. Cl.

CPC ..... *B31F 1/2822* (2013.01); *B41J 13/0063* (2013.01); *B41J 25/3082* (2013.01); *B41J 11/70* (2013.01)

(58) Field of Classification Search

USPC ..... 156/350, 353, 388, 510, 525

See application file for complete search history.

(56) References Cited

U.S. PATENT DOCUMENTS 2,309,728 A * 2/1943 Goettsch ..... B26D 9/00 156/269
2004/0017456 A1* 1/2004 Obertegger ..... B41J 3/4078 347/104
2004/0159693 A1 8/2004 Adachi et al.

(Continued)

FOREIGN PATENT DOCUMENTS

JP 62-290527 A 12/1987
JP 2002-249117 A 9/2002

(Continued)

*Primary Examiner* — Sing P Chan

(74) *Attorney, Agent, or Firm* — Brinks Gilson & Lione

(57) ABSTRACT

A corrugated paperboard sheet manufacturing apparatus (1) comprises a single facer (8) for preparing a single-faced corrugated paperboard sheet (6), a double facer (12) for preparing a double-faced corrugated paperboard sheet (12), a slitter-scorer (17) for performing a scoring and a slitting of the double-faced corrugated paperboard sheet (10), a cutter (20) for cutting the double-faced corrugated paperboard sheet (10) after the scoring and slitting, and a printer (18) for printing individual identification information on the double-faced corrugated paperboard sheet, in a non-contact state. The printer (18) is disposed on a conveyance line of the corrugated paperboard sheet manufacturing apparatus (1) at a position on a downstream side of the double facer (12).

17 Claims, 20 Drawing Sheets

(56) References Cited

U.S. PATENT DOCUMENTS

| | | | | |
|---|---|---|---|---|
| 2010/0218653 | A1* | 9/2010 | Okihara | B26D 1/245<br>83/13 |
| 2013/0029825 | A1* | 1/2013 | Rich | B41J 3/543<br>493/324 |

FOREIGN PATENT DOCUMENTS

| | | | |
|---|---|---|---|
| JP | 2004-243643 | A | 9/2004 |
| JP | 2010-017885 | A | 1/2010 |

* cited by examiner

CORRUGATED PAPERBOARD SHEET MANUFACTURING APPARATUS

RELATED APPLICATIONS

This application claims priority under 35 U.S.C. § 119 to Japanese Patent Applications No. 2015-116876 filed on Jun. 9, 2015, No. 2015-116877 filed on Jun. 9, 2015, and No. 2015-116878 filed on Jun. 9, 2015, the entire contents of which are hereby incorporated by reference.

BACKGROUND OF THE INVENTION

1. Field of the Invention

The present invention relates to a corrugated paperboard sheet manufacturing apparatus, and particularly to a corrugated paperboard sheet manufacturing apparatus having a printer on a conveyance line of a corrugated paperboard sheet.

2. Description of the Related Art

Heretofore, a corrugated paperboard sheet manufacturing apparatus (so-called "corrugator") has been configured to manage production information about a corrugated paperboard sheet to be manufactured. For example, Patent Document 1 (Japanese Unexamined Patent Application Publication No. 2002-249117) discloses a stacker disposed on the downstreammost side of a conveyance line in a corrugator, more specifically, a technique of inserting a product tag which describes production information about a corrugated paperboard sheet, such as configuration and date of manufacturing thereof, into a batch of stacked corrugated paperboard sheets.

On the other hand, for example, Patent Document 2 (Japanese Unexamined Patent Application Publication No. S62-290527) discloses a technique of providing a printer equipped with a plate cylinder and an impression cylinder, at a position between a pre-heater and a gluing machine, and printing a barcode for obtaining therefrom information about a commercial product to be put in a finished corrugated paperboard box, on a front liner by the printer.

SUMMARY OF THE INVENTION

Technical Problem

Recent years, in regard to a corrugated paperboard sheet produced by a corrugator, it is desired to achieve a higher level of quality control for a glue-based bonded state between a corrugated medium and a liner, and accuracy in processed (machined) dimensions by a slitter and a cutter. From such background, in a box making line for processing a corrugated paperboard sheet produced by the corrugator, into a box, and in a stage where the produced box is subsequently used by an end-user, it is desired to allow information at a time when an individual one of a plurality of corrugated paperboard sheets is produced by the corrugator to be checked up, i.e., it is desired to ensure traceability.

The product tag described in the Patent Document 1 is given to the batch of stacked corrugated paperboard sheets for one manufacturing order, with the same production information such as date of manufacturing. Thus, it is difficult to obtain, from this product tag, production information (e.g., a machine operating speed, a heating temperature by a heater, and a machine adjustment state) at a time when an individual one of the corrugated paperboard sheets is produced. Moreover, the product tag described in the Patent Document 1 is not given to respective sheet bodies of the corrugated paperboard sheets on a sheet body-by-sheet body basis. Thus, in the stage where an individual one of the corrugated paperboard sheets is used by an end-user, it is impossible to check information at a time of the production by the corrugator.

Thus, in order to allow production information at a time when each of a plurality of corrugated paperboard sheets is produced by the corrugator to be checked up in the box making line subsequent to the corrugator and in the stage of the usage by an end-user, it would be desirable to employ a process of giving a serial number unique to an individual one of the corrugated paperboard sheets, or a barcode or the like corresponding to the serial number. In this case, considering manufacturing efficiency of corrugated paperboard sheets, it is desirable to incorporate a station for giving a serial number or barcode, onto a corrugator line, i.e., into a line for producing corrugated paperboard sheets.

In this connection, a technique of, in a line for producing a corrugated paperboard sheet, printing a barcode on the corrugated paperboard sheet by a printer, has already been disclosed in the Patent Document 2, as mentioned above. However, the barcode described in the Patent Document 2 is intended to obtain therefrom information about a commercial product to be put in a finished corrugated paperboard box as a content of the box, but not intended to allow production information about each sheet body of the corrugated paperboard sheets to be checked up. Moreover, the printer described in the Patent Document 2 is a type in which a printing plate is attached to a plate cylinder. Thus, it is impossible to change a content of the barcode during operation of the corrugator, because a print pattern is set by the attached printing plate. Furthermore, without changing the printing plate, it is impossible to cope with changes in a division number, a division width and a cut length of a corrugated paperboard sheet, in accordance with an order change in the corrugator. Additionally, in the technique described in the Patent Document 2, the front liner printed with the barcode is conveyed to a double facer just after the printing, so that a printed surface is abraded by a surface of a heating plate of the double facer, thereby leading to a problem of being liable to cause deterioration in printing quality.

Because of the above reasons, the technique described in the Patent Document 2 is unsuitable for use in printing a serial number or barcode unique to an individual one of a plurality of corrugated paperboard sheets to be produced by the corrugator.

It is therefore an object of the present invention to provide a corrugated paperboard sheet manufacturing apparatus capable of adequately printing individual identification information to an individual one of a plurality of corrugated paperboard sheets in a corrugated paperboard sheet manufacturing line.

Solution to Problem

In order to achieve the above object, the present invention provides a corrugated paperboard sheet manufacturing apparatus which comprises: a single facer for bonding a corrugated medium formed with flutes and a first liner together to prepare a single-faced corrugated paperboard sheet; a double facer for bonding a second liner to the single-faced corrugated paperboard sheet to prepare a double-faced corrugated paperboard sheet; a slitter-scorer comprising a scorer for scoring the double-faced corrugated paperboard sheet and a slitter for slitting the double-faced corrugated paperboard sheet; a cutter for cutting the double-faced corrugated paperboard sheet after scoring and slitting into predetermined cut lengths in a conveyance direction of the sheet; a stacker for stacking a plurality of double-faced corrugated paperboard sheets cut off by the cutter, in an up-down direction; and a printer disposed on a conveyance line of the corrugated paperboard sheet manufacturing apparatus, at a position on a downstream side of the double facer, and configured to print individual identification information capable of identifying respective ones of the plurality of double-faced corrugated paperboard sheets cut off by the cutter, on the double-faced corrugated paperboard sheet, in a non-contact state.

In the manufacturing apparatus of the present invention having the above feature, the individual identification information capable of identifying the corrugated paperboard sheets on a sheet-by-sheet basis is printed on the corrugated paperboard sheet by the printer, and a variety of information can be associated with the individual identification information, so that it becomes possible to enhance convenience of management for the corrugated paperboard sheets and corrugated paperboard boxes formed from the corrugated paperboard sheets.

For example, from a viewpoint of allowing the individual identification information to be associated with production information (e.g., a glue-based bonded state between the corrugated medium and the liner, accuracy in processed (machined) dimensions by the slitter and the cutter, a machine operating speed, a heating temperature by a heater, and a machine adjustment state), a technique of printing the individual identification information on the corrugated paperboard sheet during a corrugated paperboard sheet manufacturing process, as in the present invention is fairly efficient, as compared to a technique of printing the individual identification information on the corrugated paperboard sheets during a box making process. Although the technique of performing printing of the individual identification information during a box making process is inefficient because of difficulty in performing collation between a corrugated paperboard sheet for which a box making process is performed, and a corrugated paperboard sheet in a preceding corrugated paperboard sheet manufacturing process, the technique of performing the printing of the individual identification information during a corrugated paperboard sheet manufacturing process is efficient because of easiness in associating production information about a corrugated paperboard sheet with the individual identification information.

In the manufacturing apparatus of the present invention, the printer is disposed downstream of the double facer, so that it becomes possible to avoid a situation where a printed surface is abraded by a surface of a heating plate of a double facer in an apparatus (e.g., an apparatus described in the Patent Document 2) in which a printer is disposed upstream of the double facer, and thus prevent deterioration in printing quality.

In the manufacturing apparatus of the present invention, the printer is configured to perform the printing on the corrugated paperboard sheet in a non-contact state without any need for a printing plate, so that it becomes possible to change a content of the individual identification information easily and adequately during manufacturing of corrugated paperboard sheets, as compared to an apparatus (e.g., the apparatus described in the Patent Document 2) configured to perform printing using a printing plate.

Preferably, in the manufacturing apparatus of the present invention, the printer is disposed at a position between the slitter-scorer and the cutter.

In the manufacturing apparatus having this feature, it becomes possible to suppress the occurrence of a situation where a printing target location is influenced by disturbances, such as an error in cutting by the cutter (deviation in cutting position), and cutting off a defective portion of a corrugated paperboard sheet, which is commonly performed on a downstream side of the cutter. Thus, it becomes possible to ensure printing accuracy in the conveyance direction of the corrugated paperboard sheet. That is, it becomes possible to suppress printing misalignment in the conveyance direction.

Preferably, in the manufacturing apparatus of the present invention, the printer is disposed near the scorer and/or the slitter of the slitter-scorer.

In the manufacturing apparatus having this feature, it becomes possible to perform the printing on the corrugated paperboard sheet in a state in which it is substantially pressed by respective processing (machining) operations of the scorer and/or the slitter. In this state, accuracy in conveyance of the corrugated paperboard sheet is high, more specifically, width-directional displacement of the corrugated paperboard sheet during conveyance is suppressed, so that it becomes possible to ensure printing accuracy in the width direction of the corrugated paperboard sheet. That is, it becomes possible to suppress printing misalignment in the width direction.

Additionally, in this manufacturing apparatus, the printing is performed at a position close to a position in which scoring and/or slitting are performed, respectively, by the slitter-scorer, so that it becomes possible to effectively suppress a deviation in a dimension between the processing (machining) position and the printing position.

Preferably, in the above manufacturing apparatus, the printer is disposed at a position between the scorer and the slitter of the slitter-scorer.

In the manufacturing apparatus having this feature, it becomes possible to perform the printing on the corrugated paperboard sheet in a state in which it is pressed by respective processing (machining) operations of the scorer and the slitter, so as to be kept from displacement of the corrugated paperboard sheet in the width direction, thereby effectively enhancing printing accuracy in the width direction of the corrugated paperboard sheet.

Additionally, the printing is performed at a position close to a position in which scoring and slitting are performed, respectively, by the slitter-scorer, so that it becomes possible to effectively suppress a deviation in a dimension between the processing (machining) position and the printing position.

Preferably, the manufacturing apparatus of the present invention further comprises a control device for controlling the printer, wherein, every time the cutter cuts the double-faced corrugated paperboard sheet, the control device sets a printing target location on the double-faced corrugated paperboard sheet where the individual identification information is to be printed by the printer.

In the manufacturing apparatus having this feature, it becomes possible to suppress an influence of an error in cutting by the cutter on the printing target location. More specifically, it becomes possible to suppress the occurrence of a situation where, due to an influence of accumulated deviations in cutting position occurring during the cutting performed plural times, a printing target location is largely deviated in the conveyance direction.

Preferably, in the above manufacturing apparatus, the control device controls the printer to print the individual identification information on the double-faced corrugated paperboard sheet, when the double-faced corrugated paperboard sheet is conveyed after the cutting by the cutter, by a length corresponding to a distance between the printing target location set on the double-faced corrugated paperboard sheet at the time of the said cutting by the cutter and a position at which the printer performs the printing.

In the manufacturing apparatus having this feature, it becomes possible to adequately print the individual identification information in the printing target location set on the corrugated paperboard sheet.

Preferably, in the manufacturing apparatus of the present invention, wherein the plurality of double-faced corrugated paperboard sheets cut off by the cutter are conveyed in such a manner that adjacent ones thereof in the conveyance direction are partially superposed on each other, and then stacked on the stacker in the up-down direction, and the printer is disposed at a position on the downstream side of the cutter and in a region of the conveyance line where at least one of the double-faced corrugated paperboard sheets is conveyed in a state in which it has not yet been partially superposed with another.

In the manufacturing apparatus having this feature, the printer is disposed at a position on the downstream side of the cutter and in a region of the conveyance line where at least one corrugated paperboard sheet is conveyed in a state in which it has not yet been partially superposed with another, so that it becomes possible to suppress the occurrence of a situation where a printing target location is influenced by disturbances, such as an error in cutting by the cutter (deviation in cutting position), and cut-off of a defective portion of a corrugated paperboard sheet, which is commonly performed on a downstream side of the cutter.

Preferably, the above manufacturing apparatus further comprises a control device for controlling the printer, wherein, every time the cutter cuts the double-faced corrugated paperboard sheet, the control device sets a position on the double-faced corrugated sheet away by a predetermined distance from a leading edge of the double-faced corrugated paperboard sheet formed by the cutting, as a printing target location where the individual identification information is to be printed by the printer.

In the manufacturing apparatus having this feature, it becomes possible to suppress an influence of an error in cutting by the cutter on the printing target location on the double-faced corrugated paperboard sheet.

Preferably, in the above manufacturing apparatus, the control device controls the printer to print the individual identification information on the double-faced corrugated paperboard sheet, when the double-faced corrugated paperboard sheet is conveyed by a length corresponding to the predetermined distance after the leading edge of the said double-faced corrugated paperboard sheet passes through the printing position at which the printer performs the printing just after setting the printing target location.

In the manufacturing apparatus having this feature, it becomes possible to adequately print the individual identification information in the set printing target location.

Preferably, in the manufacturing apparatus of the present invention, the stacker stacks the plurality of double-faced corrugated paperboard sheets cut off by the cutter in the up-down direction, after being brought into a state in which adjacent ones thereof in the conveyance direction are partially superposed on each other, and the printer is disposed at a position on the downstream side of the cutter and in a region of the conveyance line where at least a part of the plurality of double-faced corrugated paperboard sheets are conveyed in a partially-superposed state.

In the manufacturing apparatus having this feature, a conveyance speed of the corrugated paperboard sheets in the installation position of the printer is lower than that in a region on the upstream side of the position, so that there is no need to increase a printing speed, i.e., there is no need to perform the printing at a high speed, following corrugated paperboard sheets conveyed at a high speed. Thus, it becomes possible to construct the printer for use in the corrugated paperboard sheet manufacturing apparatus, at a lower cost and with a simplified structure.

Preferably, the above manufacturing apparatus further comprises: a control device for controlling the printer; and a detection device for detecting a leading edge of each of the double-faced corrugated paperboard sheets being conveyed in the partially-superposed state, wherein, every time the detection device detects the leading edge of each of the double-faced corrugated paperboard sheets, the control device sets a printing target location on the double-faced corrugated paperboard sheet where the individual identification information is to be printed by the printer.

In the manufacturing apparatus having this feature, it becomes possible to adequately set a desired printing target location in each of the plurality of corrugated paperboard sheets being conveyed.

Preferably, in the above manufacturing apparatus, the control device controls the printer to print the individual identification information on the double-faced corrugated paperboard sheet, when the double-faced corrugated paperboard sheet is conveyed after a detection of the leading edge thereof by the detection device, by a length corresponding to a distance between the printing target location set on the double-faced corrugated paperboard sheet at the time of the said detection of the leading edge and a position at which the printer performs the printing.

In the manufacturing apparatus having this feature, it becomes possible to adequately print the individual identification information on the set printing target location.

Preferably, in the above manufacturing apparatus, the printer prints the individual identification information on the double-faced corrugated paperboard sheet at a position in a region thereof where other double-faced corrugated paperboard sheets are not superposed thereon.

In the manufacturing apparatus having this feature, it becomes possible to adequately suppress the occurrence of a situation where the individual identification information is printed in a region across two adjacent corrugated paperboard sheets, or the individual identification information is printed in a front-side or rear-side corrugated paperboard sheet, instead of a target corrugated paperboard sheet.

Preferably, the above manufacturing apparatus further comprises: a control device for controlling the printer; and a detection device for detecting a height position of each of the double-faced corrugated paperboard sheets conveyed in the partially-superposed state, wherein the printer comprises an inkjet head and an up-down moving mechanism for moving the inkjet head in an up-down direction, and wherein the control device controls the up-down moving mechanism to move the inkjet head to an up-down position in accordance with the height position of the double-faced corrugated paperboard sheet detected by the detection device.

In the manufacturing apparatus having this feature, it becomes possible to adequately cope with the corrugated paperboard sheets being conveyed in the partially superimposed state to thereby have various height positions. More specifically, it becomes possible to suppress the occurrence of a situation where a distal end of the inkjet head comes into contact with one of the corrugated paperboard sheets, and allow the distal end of the inkjet head to be spaced apart from a surface of each of the corrugated paperboard sheets by an adequate distance so as to adequately perform the printing for the corrugated paperboard sheet.

Preferably, the above manufacturing apparatus further comprises: a control device for controlling the printer; and a detection device for detecting a trailing edge of a rearmost one of the double-faced corrugated paperboard sheets conveyed in the partially-superposed state, wherein, when the detection device detects the trailing edge of the rearmost double-faced corrugated paperboard sheet, the control device determines that an order change has been made, and then controls the printer in accordance with the order change.

In the manufacturing apparatus having this feature, when the trailing edge of the rearmost one of the group of corrugated paperboard sheets 10 is detected by the height detection sensor, it is determined that an order change has been made, and control according to the order change can be quickly performed.

Preferably, in the above manufacturing apparatus, the printer comprises an inkjet head, and the inkjet head and the detection device are provided with respect to a same conveyer for conveying the double-faced corrugated paperboard sheets.

In the manufacturing apparatus having this feature, it becomes possible to easily control the inkjet head based on the detection signal of the height detection sensor, and accurately control the inkjet head based on the detection signal of the height detection sensor, as compared to the case where the inkjet head and the height detection sensor are provided, respectively, to different conveyers.

Preferably, in the manufacturing apparatus of the present invention, the printer comprises a plurality of inkjet heads arranged side-by-side in a width direction relative to the conveyance direction, wherein the individual identification information includes a serial number, wherein the corrugated paperboard sheet manufacturing apparatus further comprises a control device for controlling the printer, wherein the control device selects appropriate ones of the plurality of inkjet heads based on a division number which is the number of output sheets divided from the double-faced corrugated paperboard sheet in the width direction, in order to print the individual identification information on the double-faced corrugated paperboard sheet by using each of the selected inkjet heads, and wherein, every time the individual identification information is printed on the double-faced corrugated paperboard sheet, the control device determines a number by adding a value corresponding to the division number to a number corresponding to the printed individual identification information, as new individual identification information to be subsequently printed on the double-faced corrugated paperboard sheet, in order to set the determined number to each of the selected inkjet heads.

In the manufacturing apparatus having this feature, it becomes possible to print consecutive numbers to the corrugated paperboard sheets to be manufactured, sequentially and adequately.

Preferably, in the manufacturing apparatus of the present invention, the printer comprises: a plurality of inkjet heads arranged side-by-side in a width direction relative to the conveyance direction; an up-down moving mechanism for moving each of the inkjet heads in an up-down direction; and a width-direction moving mechanism for moving each of the inkjet heads in a width direction.

In the manufacturing apparatus having this feature, each of the plurality of inkjet heads arranged side-by-side in the width direction can be moved in the up-down direction and the width direction by using the up-down moving mechanism and the width-direction moving mechanism of the printer, so that it becomes possible to adequately and quickly cope with changes in the division number, a thickness of the corrugated paperboard sheet, the printing target position where the individual identification information is to be printed on the corrugated paperboard sheets, and the like.

Preferably, in the above manufacturing apparatus, the printer comprises two sets of the plurality of inkjet heads arranged side-by-side in the width direction, the two sets of the plurality of inkjet heads being arranged along the conveyance direction.

In the manufacturing apparatus having this feature, the two inkjet unit sets can be switchingly used according to order change, so that it becomes possible to adequately cope with an increase in production speed of corrugated paperboard sheets, an increase in number of times of order change, and the like.

The present invention makes it possible to adequate print the individual identification information on the corrugated paperboard sheet on a sheet-by-sheet basis, in a corrugated paperboard sheet manufacturing process.

DETAILED DESCRIPTION OF THE PREFERRED EMBODIMENTS

With respect to the accompanying drawings, a corrugated paperboard sheet manufacturing apparatus of the present invention will now be described based on various embodiments thereof.

First Embodiment

First of all, a corrugated paperboard sheet manufacturing apparatus according a first embodiment of the present invention will be described.

(Apparatus Configuration)

Figure 1:
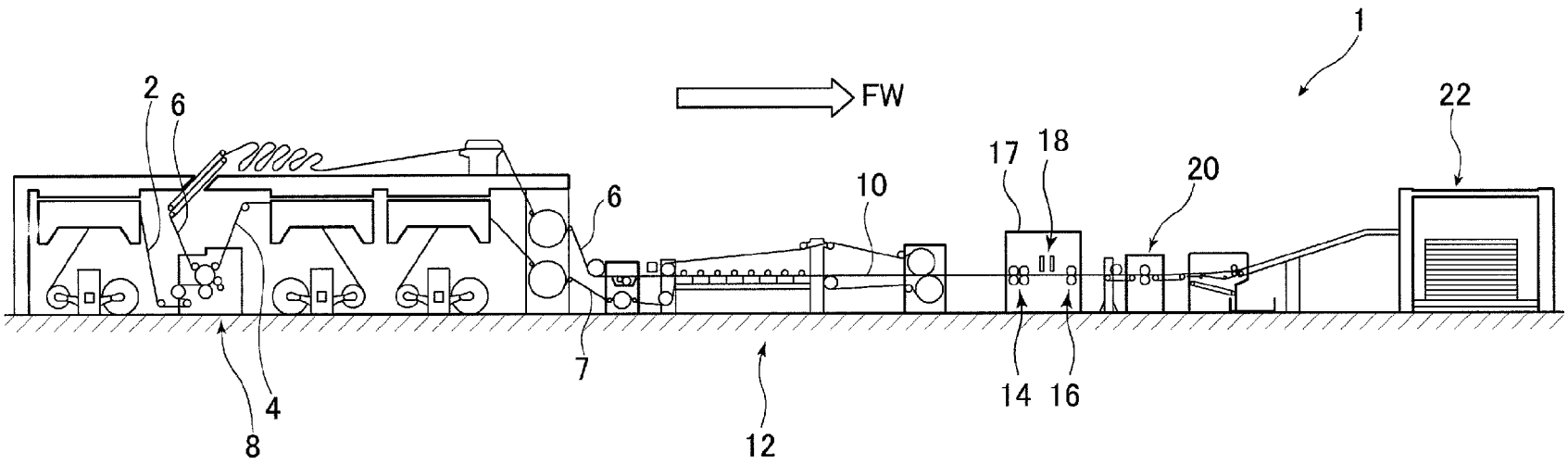
FIG. 1 is a side view depicting the entirety of a corrugated paperboard sheet manufacturing apparatus according to a first embodiment of the present invention.

With reference to FIG. 1, an overall configuration of the corrugated paperboard sheet manufacturing apparatus according the first embodiment will be described. FIG. 1 is a side view depicting the entirety of the corrugated paperboard sheet manufacturing apparatus according to the first embodiment.

As depicted in FIG. 1, the corrugated paperboard sheet manufacturing apparatus (corrugator) comprises: a single facer 8 configured to bond a corrugated medium 2 formed with flutes at a predetermined flute pitch, and a first liner 4 together to prepare a single-faced corrugated paperboard sheet 6; a double facer 12 configured to bond a second liner 7 to the single-faced corrugated paperboard sheet 6 to prepare a double-faced corrugated paperboard sheet 10; a slitter-scorer 17 comprising a scorer 14 and a slitter 16 which performs the scoring and the slitting of the double-faced corrugated paperboard sheet 10, respectively, along a conveyance (feed) direction FW (i.e., along a direction perpendicular to a flute direction); a printer 18 provided inside the slitter-scorer 17 and configured to perform printing with respect to the double-faced corrugated paperboard sheet 10; a cutter 20 configured to sequentially cut the double-faced corrugated paperboard sheet 10 to predetermined cut lengths in the conveyance direction FW to prepare a plurality of double-faced corrugated paperboard sheets 10; and a stacker 22 configured to stack the plurality of double-faced corrugated paperboard sheets 10 in an up-down direction. In the following description, the double-faced corrugated paperboard sheet 10 will be also referred to simply as "corrugated paperboard sheet 10".

Figure 2:
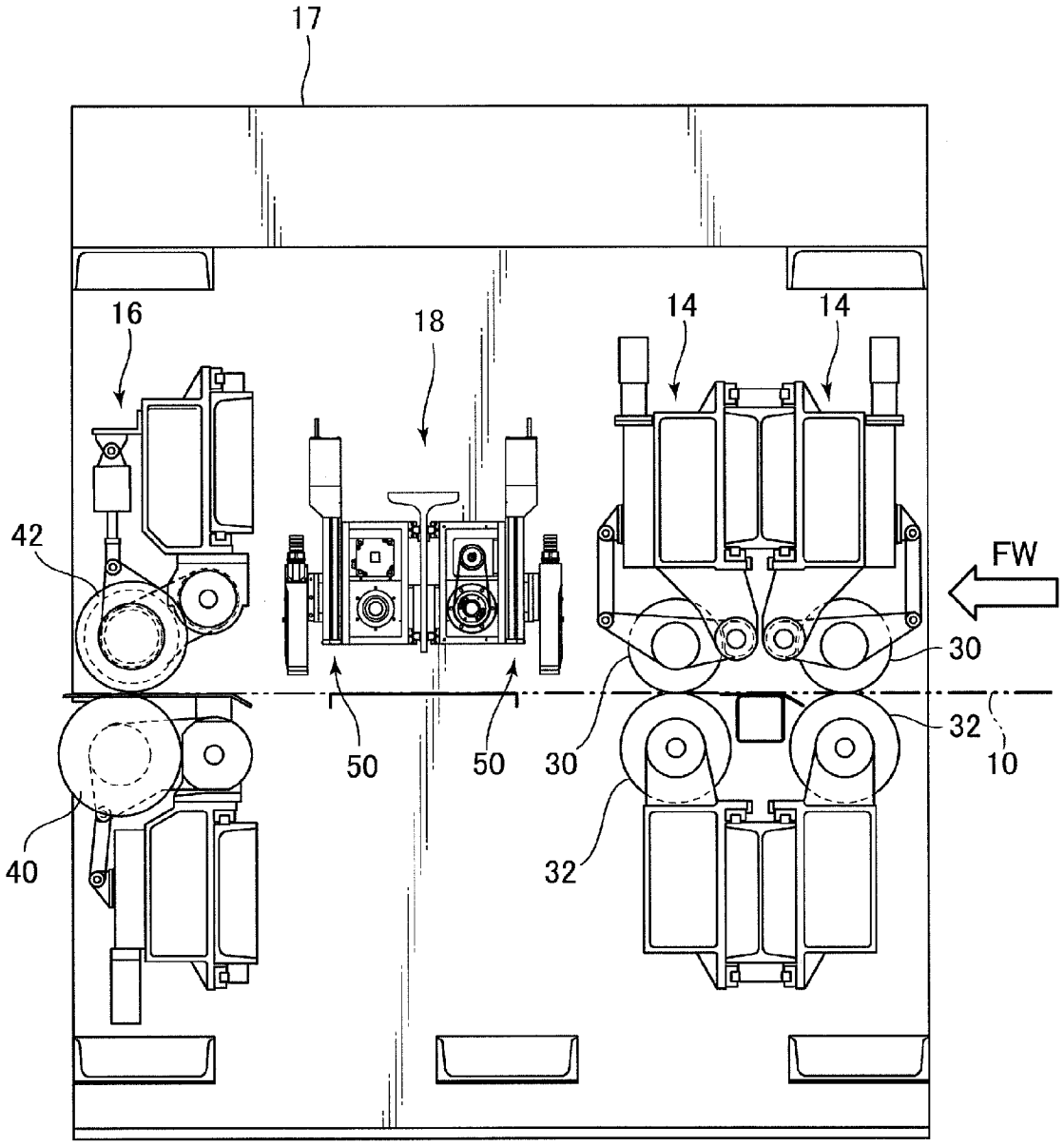
FIG. 2 is a schematic side view depicting a slitter-scorer in the first embodiment.

Next, with reference to FIG. 2, a configuration of the slitter-scorer in the first embodiment will be described. FIG. 2 is a schematic side view depicting the slitter-scorer in the first embodiment.

As depicted in FIG. 2, in the slitter-scorer 17, the scorer 14 is provided in a number of two, on an upstream side in the conveyance direction FW, and the slitter 16 is provided in a number of one, on a downstream side in the conveyance direction FW. The printer 18 is disposed between a set of the scorers 14, and the slitter 16. That is, the printer 18 is incorporated in the slitter-scorer 17.

Each of the scorers 14 primarily comprises an upper scoring roll 30 and a lower scoring roll 32. A set of the upper scoring roll 30 and the lower scoring roll 32 is plurally provided in a width direction of the slitter-score 17 (although not depicted). The scorer 14 comprises an up-down moving mechanism configured to move the upper scoring roll 30 in an up-down direction between a position for performing the scoring and a position for avoiding the scoring (standby position). The scorer 14 further comprises a width-direction moving mechanism configured to move each of the sets of the upper scoring roll 30 and the lower scoring roll 32 in the width direction.

The slitter 16 primarily comprises a slitter knife 40 and a slitter knife receiving member 42. A set of the slitter knife 40 and the slitter knife receiving member 42 is plurally provided in the width direction of the slitter-score 17 (although not depicted). The slitter 16 comprises an up-down moving mechanism configured to move the slitter knife 40 in an up-down direction between a position for performing the slitting and a position for avoiding the slitting (standby position). The slitter 16 further comprises a width-direction moving mechanism configured to move each of the sets of the slitter knife 40 and the slitter knife receiving member 42 in the width direction.

Figure 3:
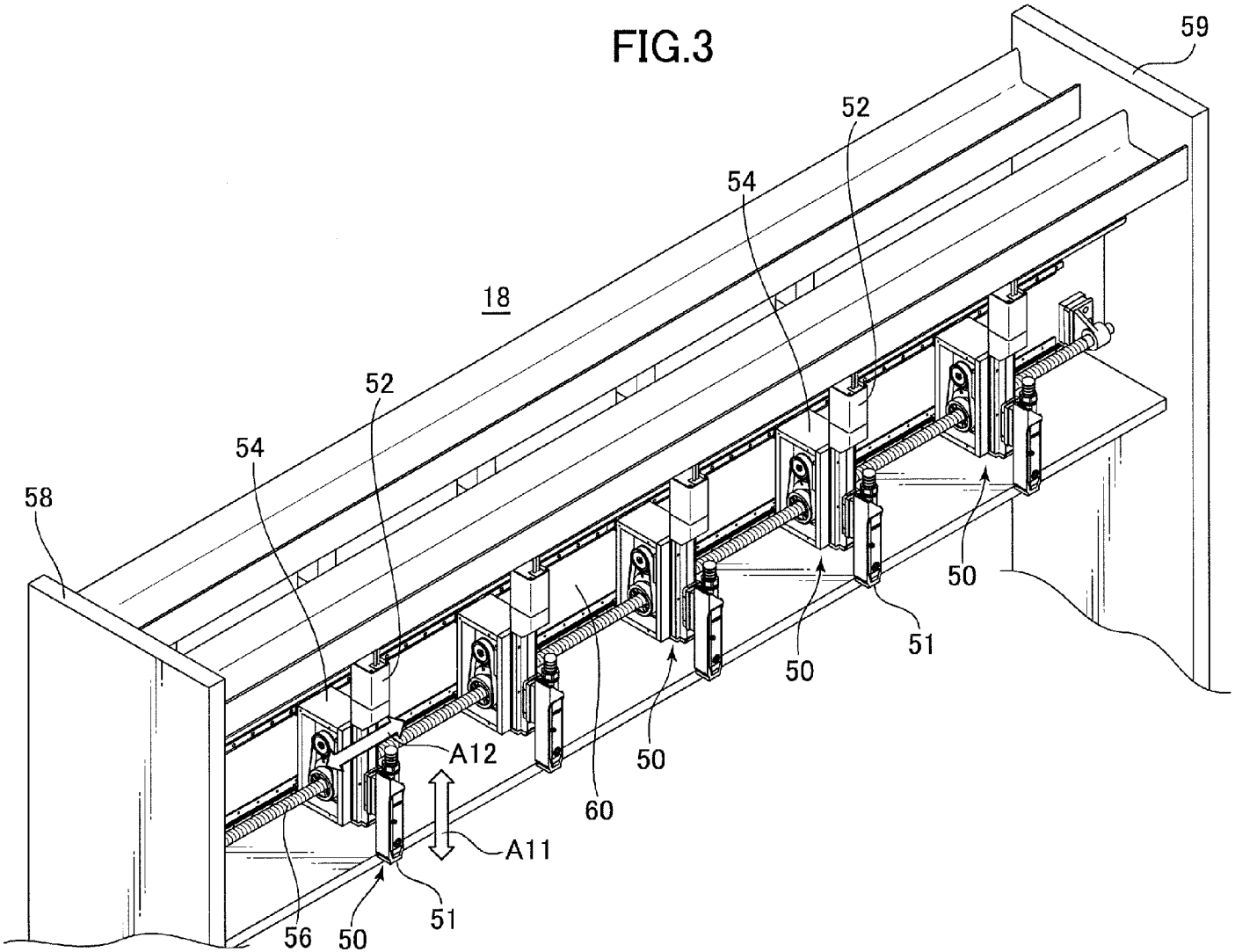
FIG. 3 is a perspective view depicting an overall configuration of a printer in the first embodiment.
Figure 4:
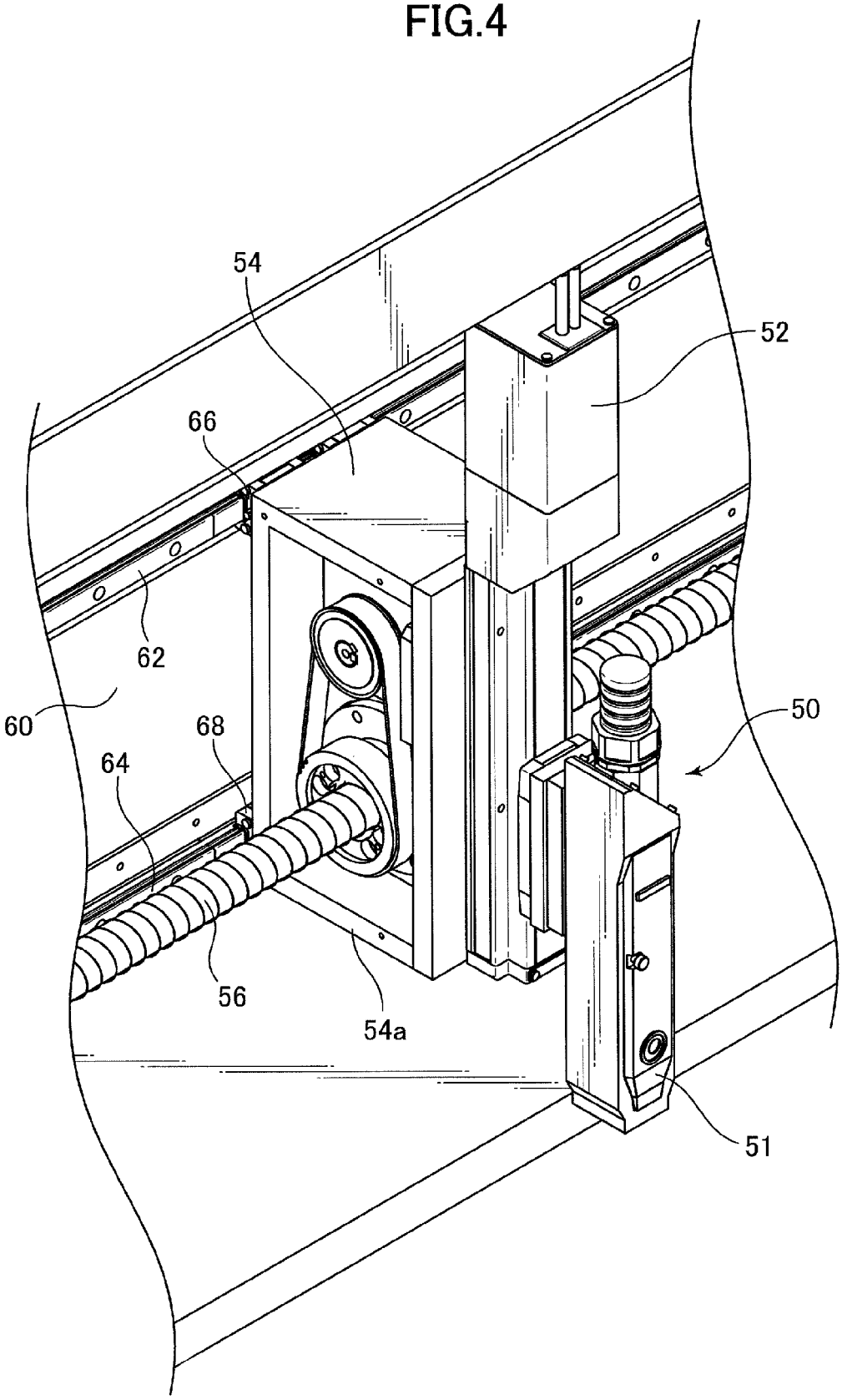
FIG. 4 is a perspective view enlargedly depicting a part of the printer in the first embodiment.
Figure 5:
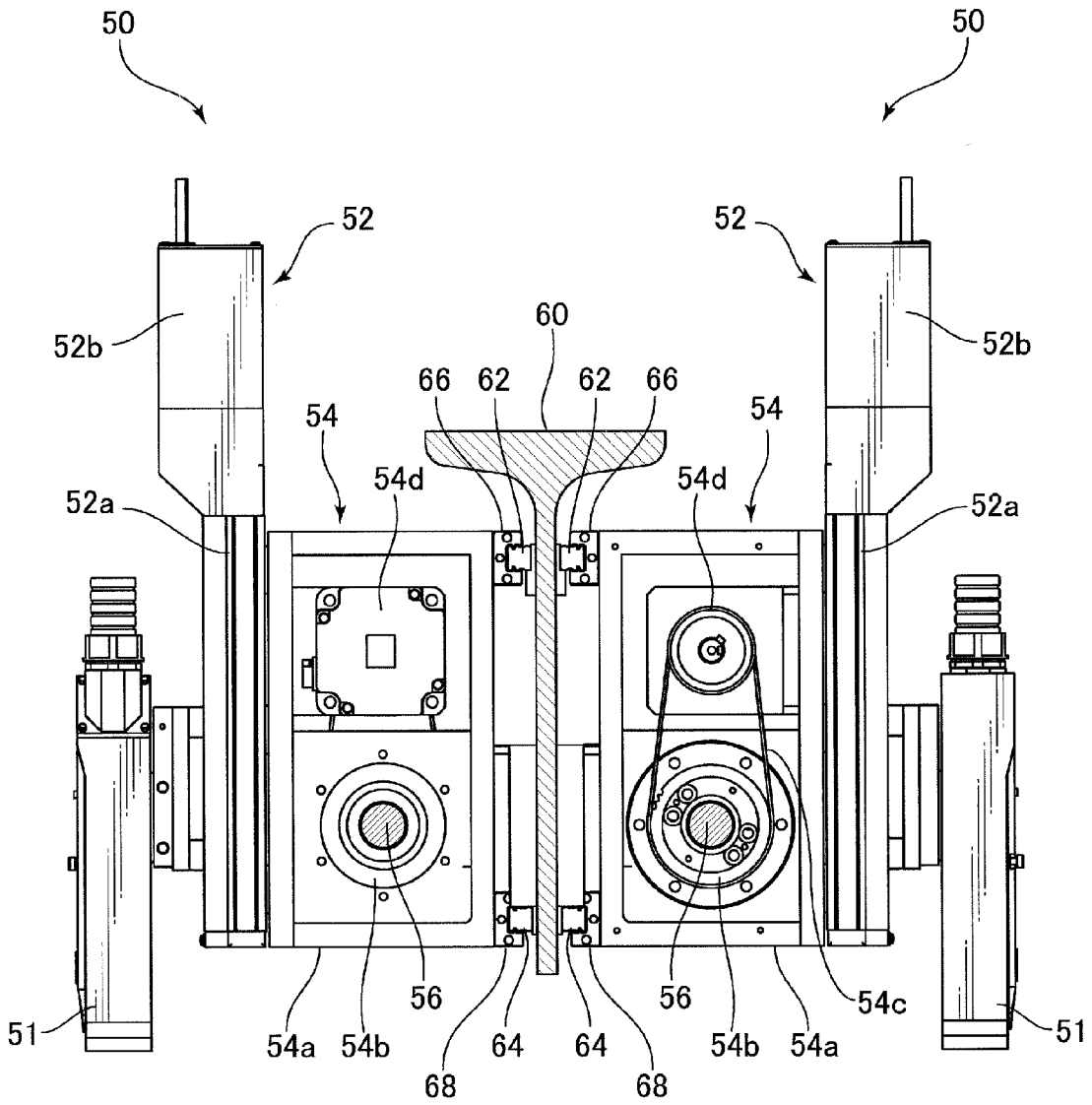
FIG. 5 is a side view of an inkjet unit of the printer in the first embodiment.

Next, with reference to FIGS. 3 to 5, a configuration of the printer in the first embodiment will be specifically described. FIG. 3 is a perspective view depicting an overall configuration of the printer in the first embodiment, and FIG. 4 is a perspective view enlargedly depicting a part (a portion including an inkjet unit) of the printer in the first embodiment. FIG. 5 is a side view of the inkjet unit of the printer in the first embodiment.

As depicted in FIG. 3, the printer 18 comprises an inkjet unit 50 having an inkjet head (inkjet nozzle) 51, wherein the inkjet unit 50 is provided to be located above a corrugated paperboard sheet 10 passing through the slitter-scorer 17. The inkjet unit 50 is provided plurally (more specifically, in a number of five), along a width direction of the printer 18, wherein the plurality of inkjet units 50 are configured to simultaneously perform printing on a plurality of areas (in a continuous (undivided) region where the slitting is not performed by the slitter 16 of the slitter-scorer 17) of the corrugated paperboard sheet 10 being fed. The printer 18 has two sets of the five inkjet units 50, wherein the two sets are arranged along the conveyance direction FW, i.e., arranged in tandem (see FIGS. 2 and 5).

In the following description, one of the sets of the five inkjet units 50 disposed on an upstream side in the conveyance direction FW will be appropriately referred to as "upstream-side inkjet unit set", and the other set of the five inkjet units 50 disposed on a downstream side in the conveyance direction FW will be appropriately referred to as "downstream-side inkjet unit set". Fundamentally, in one production order, only one of the upstream-side inkjet unit set and the downstream-side inkjet unit set is used for printing, and, in response to a production order change, the inkjet unit set to be used is switched over to the other.

In addition to the inkjet head 51, each of the inkjet units 50 comprises: an up-down moving mechanism 52 configured to move the inkjet head 51 in an up-down direction (see the double-arrowed line A11 in FIG. 3); and a width-direction moving mechanism 54 configured to move the entire inkjet unit 50 including the inkjet head 51 and others in the width direction (see the double-arrowed line A12 in FIG. 3), whereby the five inkjet units 50 can be moved in the up-down direction and the width direction, individually.

The inkjet head 51 in each of the inkjet units 50 is configured to perform ink-jet printing, thereby perform printing with respect to the corrugated paperboard sheet 10, in a non-contact state. Instead of a so-called "serial head system" in which an inkjet head is moved in a direction perpendicular to a direction along which a printing target medium is moved, this inkjet head 51 employs a so-called "line head system" in which a relatively large-size inkjet head is used to perform printing in a fixed state, while moving only a printing target medium. In this embodiment, the inkjet head 51 is operable to print individual identification information, such as a serial number or a barcode, capable of identifying a plurality of corrugated paper board sheets 10 on a sheet-by-sheet basis. Thus, a size allowing such a serial number or a barcode to be printed in the line head system is applied to the inkjet head 51. The inkjet head 51 is connected to a non-depicted ink tank (e.g., disposed in an upper section of the printer 18) via a non-depicted ink tube so as to be supplied with ink from the ink tank.

Each of the inkjet units 50 is attached to a fixed member 60 disposed to extend in the width direction between two frames 58, 59 located at respective width-directionally opposite ends of the printer 18, (wherein the frames 58, 59 extend over the slitter-scorer 17 along the conveyance direction FW to construct a frame of the entire slitter-scorer 17). More specifically, as depicted in FIGS. 4 and 5, each of the inkjet units 50 is attached to the fixed member 60 in such a manner that a cross-sectionally angular C-shaped guide member 66 (68) fixed to a frame 54*a* of the width-direction moving mechanism 54 of the inkjet unit 50 is engaged with a width-directionally extending guide body 62 (64) fixed to the fixed frame 60. In this case, when the guide member 66 (68) fixed to the width-direction moving mechanism 54 is slidingly moved along the guide body 62 (64) fixed to the fixed frame 60 to serve as a rail, the inkjet unit 50 is moved in the width direction in a guided manner.

As depicted in FIG. 5, the up-down moving mechanism 52 of the inkjet unit 50 internally comprises: a threaded shaft 52*a* to which the inkjet head 51 is attached and which extends in the up-down direction; and an up-down moving motor 52*b* coupled to the threaded shaft 52*a* and configured to rotate the threaded shaft 52*a*. The up-down moving mechanism 52 is operable to activate the up-down moving motor 52*b* to rotate the threaded shaft 52 to thereby move the inkjet head 51 attached to the threaded shaft 52*a*, in the up-down direction.

On the other hand, as depicted in FIG. 5, in the width-direction moving mechanism 54 of the inkjet unit 50, the up-down moving mechanism 52 is fixed to the frame 54*a* thereof, and a threaded shaft 56 (additionally see FIGS. 3 and 4) disposed between the frames 58, 59 to extend in the width direction penetrates therethrough. Within the frame 54*a*, the width-direction moving mechanism 54 is provided with: a rotor 54*b* threadingly engaged with the threaded shaft 56; and a width-direction moving motor 54*d* coupled to the rotor 54*b* via a timing belt 54*c*. The width-direction moving mechanism 54 is operable to activate the width-direction moving motor 54*d* to rotate the rotor 54*b* via the timing belt 54*c* to thereby move the entire inkjet unit 50 including the width-direction moving mechanism 54, in the width direction.

Figure 6A:
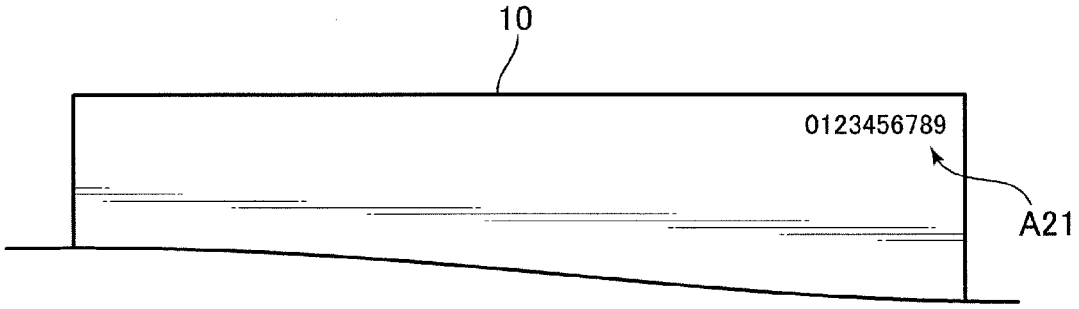
FIGS. 6A and 6B are diagrams depicting specific examples of individual identification information printed on a corrugated paperboard sheet by the printer in the first embodiment.
Figure 6B:
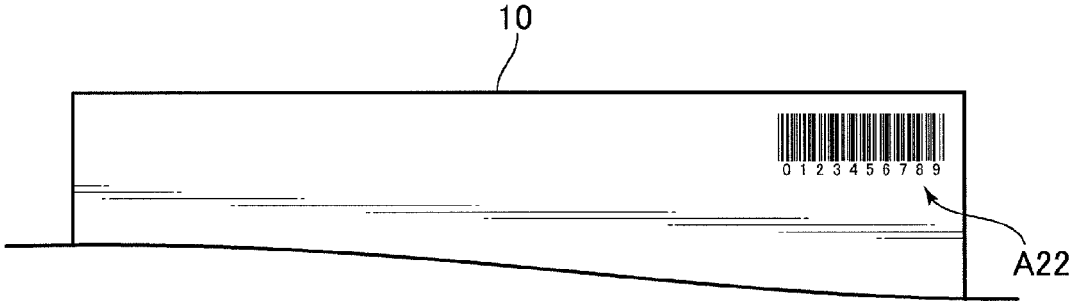

FIGS. 6A and 6B are diagrams depicting specific examples of the individual identification information printed on a corrugated paperboard sheet 10 by the printer in the first embodiment. More specifically, FIG. 6A is a diagram depicting one example of a serial number (see the arrowed line A21) printed on a corrugated paperboard sheet 10, and FIG. 6B is a diagram depicting one example of a barcode (more specifically, one dimensional barcode) (see the arrowed line A22) printed on a corrugated paperboard sheet 10.

In this embodiment, the individual identification information such as a serial number or a barcode is printed on a corrugated paperboard sheet 10 to allow a plurality of corrugated paperboard sheets 10 manufactured by the corrugated paperboard sheet manufacturing apparatus 1 to be identified on a sheet-by-sheet basis. In one example, the individual identification information is associated with production information at a time when each corrugated paperboard sheet 10 is manufactured. Examples of the production information include: a glue-based bonded state between the corrugated medium 2 and the liner 4; accuracy in processed (machined) dimensions by the slitter 16, the scorer 14 and the cutter 20; a machine operating speed; a heating temperature by a heater; and a machine adjustment state. In another example, the individual identification information is associated with information about an article contained in a corrugated paperboard box formed from the corrugated paperboard sheet 10, or information about a sender and a destination of an article contained in the corrugated paperboard box.

Figure 7:
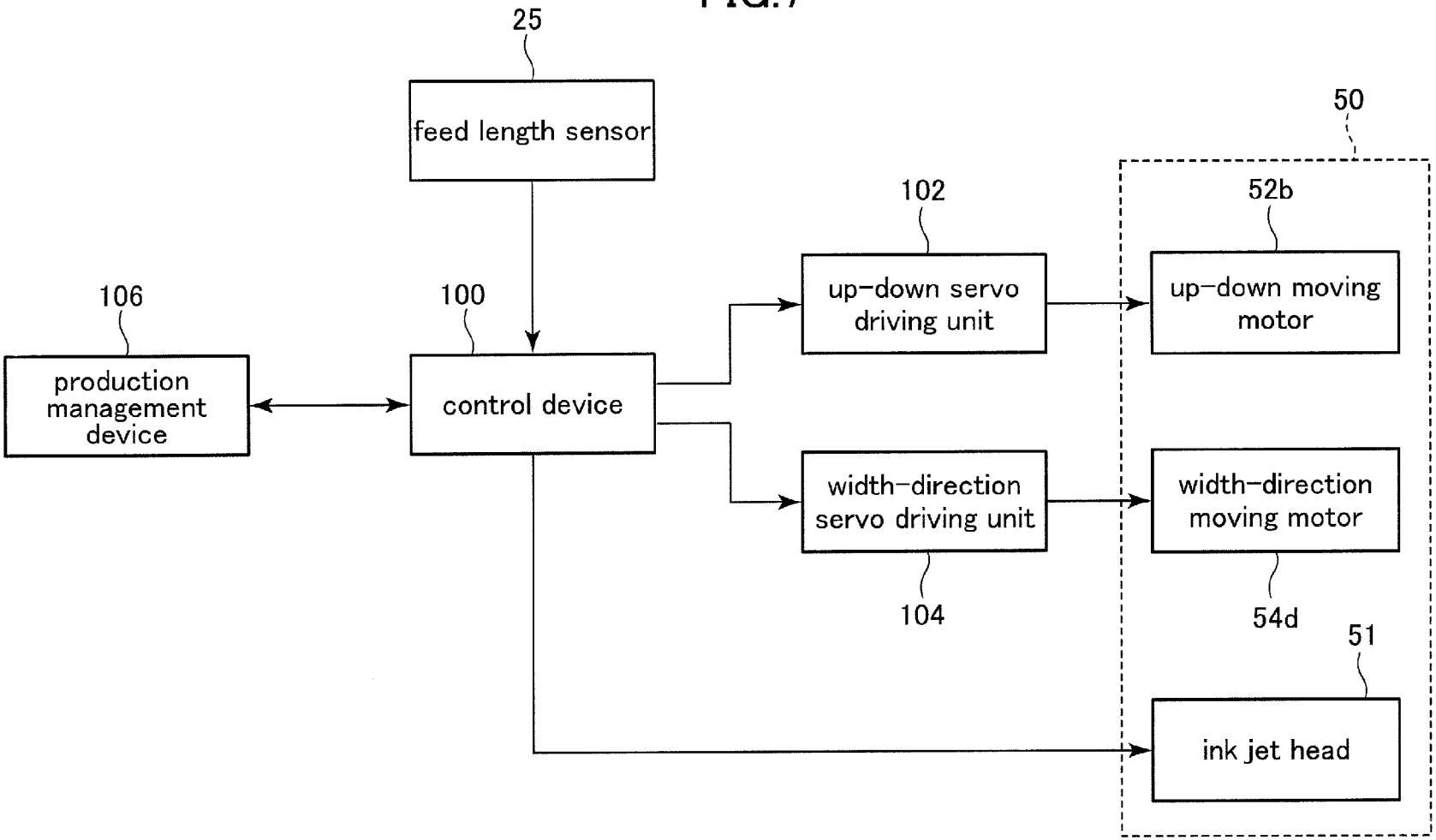
FIG. 7 is a block diagram depicting a control system for the inkjet unit of the printer in the first embodiment.

Next, with reference to FIG. 7, a control configuration of the printer in the first embodiment will be described. FIG. 7 is a block diagram depicting a control system for the inkjet unit of the printer in the first embodiment.

As depicted in FIG. 7, each of the inkjet units 50 of the printer 18 is controlled by a control device 100. More specifically, the control device 100 is operable to control the up-down moving motor 52*b* provided as a servomotor in the up-down moving mechanism 52 of the inkjet unit 50, via an up-down servo driving unit 102, to thereby move the inkjet head 51 in the up-down direction. The control device 100 is also operable to control the width-direction moving motor 54*d* provided as a servomotor in the width-direction moving mechanism 54 of the inkjet unit 50, via a width-direction servo driving unit 104, to thereby move the inkjet unit 50 in the width direction. For example, the control device 100 is operable, depending on a division number, a division width, a thickness of a corrugated paperboard sheet 10, a printing target location where the individual identification information is to be printed on the corrugated paperboard sheet 10, and the like, to control the up-down moving motor 52*b* and the width-direction moving motor 54*d* in each of the inkjet units 50 on an unit-by-unit basis to thereby move the inkjet head 51 in the up-down direction and move the inkjet unit 50 in the width direction.

Further, the control device 100 is operable to control the inkjet head 51 in each of the inkjet units 50. More specifically, the control device 100 is operable to perform various controls such as: control of setting the individual identification information to be printed by the inkjet head 51 (e.g., control of incrementing a serial number to be printed); control of setting a discharge speed of ink from the inkjet head 51, depending on a corrugated paperboard conveyance (feed) speed; and control for a timing of discharging ink from the inkjet head 51 (this timing corresponds to a timing at which a printing instruction is to be issued to the inkjet head 51). In this case, the control device 100 is configured to receive an input of a signal corresponding to a conveyance (feed) length of the corrugated paperboard sheet 10 (feed length signal) from a feed length sensor 25 provided on an upstream side of the cutter 20, and, based on the received feed length signal, output a printing instruction to the inkjet head 51. Details of this control will be described later.

The control device 100 is connected to a production management device 106 for managing the entirety of the corrugated paperboard sheet manufacturing apparatus 1, and configured to receive an input of a variety of information from the production management device 106 (while outputting a variety of information therefrom to the production management device 106), and, based, additionally, on the received information, perform the aforementioned controls.

(Contents of Control)

Figure 8:
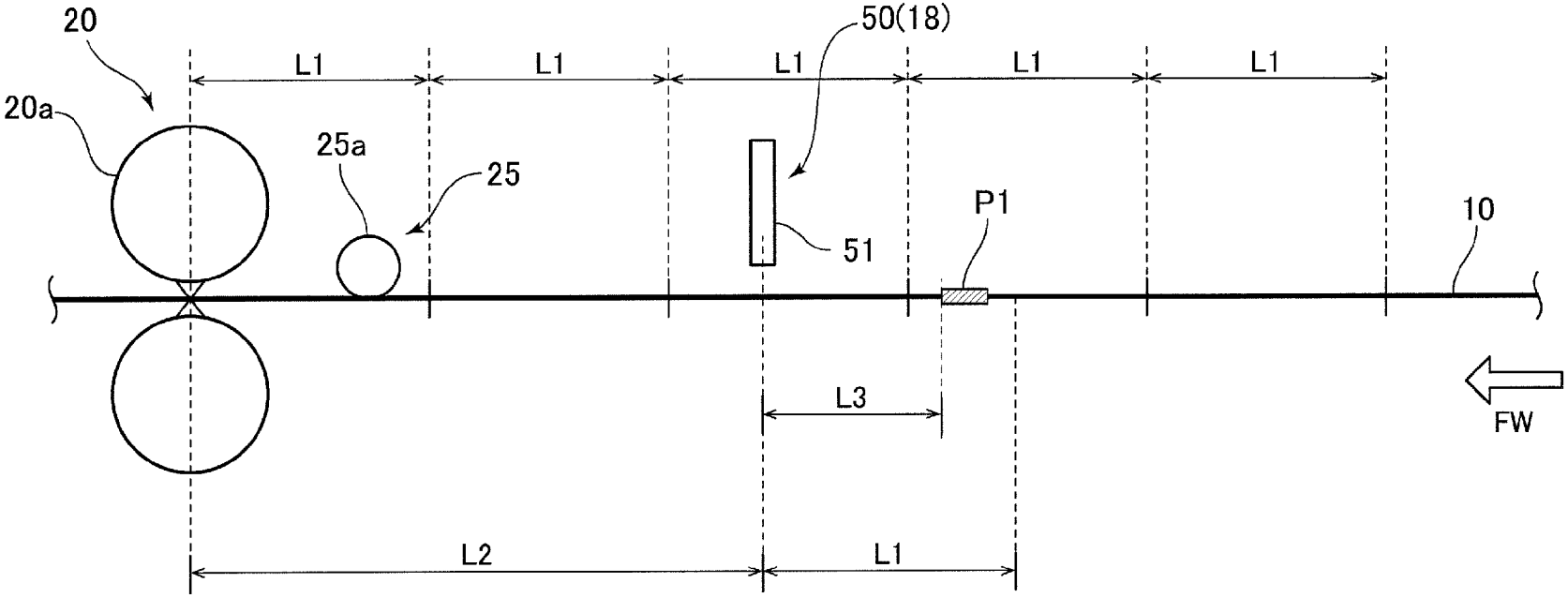
FIG. 8 is an explanatory diagram of an outline of printing control for the inkjet unit of the printer to be performed by a control device in the first embodiment.
Figure 9:
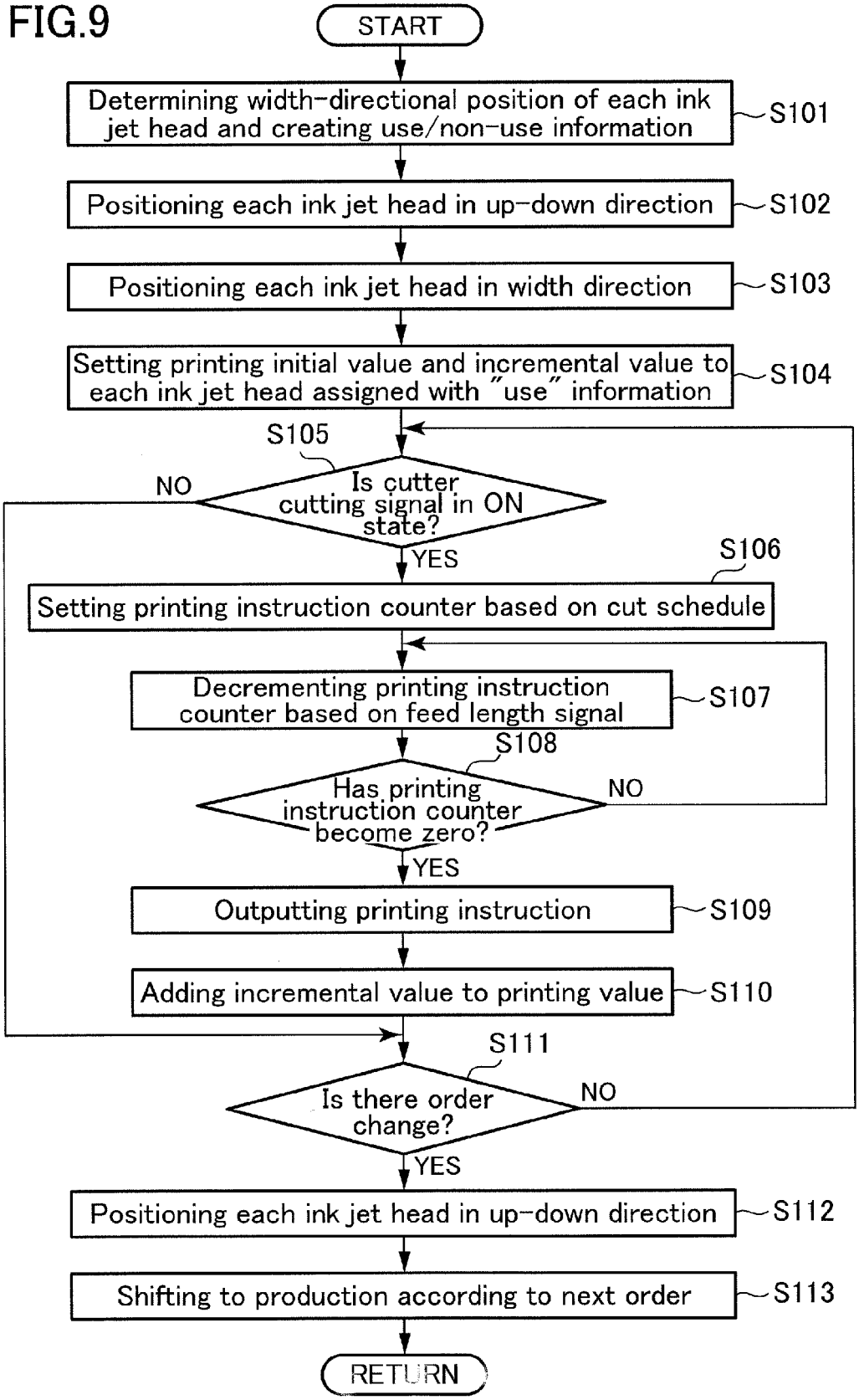
FIG. 9 is a flowchart depicting a printing control processing routine in the first embodiment.

Next, with reference to FIGS. 8 and 9, contents of control for each of the inkjet units 50 of the printer 18 to be performed by the control device 100 in the first embodiment will be specifically described.

FIG. 8 is an explanatory diagram of an outline of control (printing control) for each of the inkjet heads 51 of the printer 18 to be performed by the control device 100 in the first embodiment. FIG. 8 is a side view schematically depicting the inkjet head 51 of the printer 18 and the cutter 20.

In FIG. 8, the reference sign L1 denotes a cut length to which a corrugated paperboard sheet 10 is to be cut off by the cutter 20, and the reference sign L2 denotes a distance between a printing position at which each of the inkjet heads 51 of the inkjet units 50 performs the printing and a cutting position at which a cutter roll pair 20*a* of the cutter 20 performs cutting. The reference sign 25*a* denotes a roller 25*a* comprised in the feed length sensor 25 to serve as a measuring roll. The roller 25*a* of the feed length sensor 25 is disposed upstream of the cutter roll pair 20*a* of the cutter 20, for example, by about 1 m, in contact relation with a corrugated paperboard sheet 10, and configured to be rotated along with a movement of the corrugated paperboard sheet 10 being conveyed (fed) so as to output a feed length signal (corresponding to a length by which the corrugated paperboard sheet 10 is conveyed (fed)) according to the rotation to the control device 100.

In this embodiment, the control device 100 is operable, at a timing when the cutter 20 cuts the corrugated paperboard sheet 10, to set, on the corrugated paperboard sheet 10, a printing target site P1 where the individual identification information is to be printed by the inkjet head 51 of the inkjet unit 50. More specifically, the control device 100 is operable, every time the cutter 20 cuts the corrugated paperboard sheet 10, to, based on a position of a cut line along which the corrugated paperboard sheet 10 is cut by the cutter 20 this time, create a cut schedule indicative of a position of a cut line along which the corrugated paperboard sheet 10 is to be cut by the cutter 20 next time, and, according to the cut schedule, set, on the corrugated paperboard sheet 10, a printing target site P1 where the individual identification information is to be printed by the inkjet head 51. In this case, the control device 100 is operable, every time the cutter 20 cuts the corrugated paperboard sheet 10, to set a counter (hereinafter referred to as "printing instruction counter") to a value corresponding to a distance L3 (L3<L1) between the printing position at which each of the inkjet heads 51 performs the printing, and a position of a leading edge of the printing target site P1 set on the corrugated paperboard sheet 10. A relationship between the distance L3 and the value of the printing instruction counter is equivalent to a relationship between an actual length by which the corrugated paperboard sheet 10 is conveyed (fed) and a value corresponding to the feed length signal from the feed length sensor 25.

Then, the control device 100 is operable to decrement the value of the printing instruction counter set in the above manner, according to the feed length signal from the feed length sensor 25. As a result, the value of the printing instruction counter finally becomes zero. A timing when the value of the printing instruction counter becomes zero corresponds to a timing when the corrugated paperboard sheet 10 after being cut by the cutter 20 is conveyed by a length corresponding to the distance L3 between the leading edge position of the printing target site P1 set on the corrugated paperboard sheet 10 and the printing position at which each of the inkjet heads 51 performs the printing, i.e., a timing when the leading edge position of the printing target site P1 set on the corrugated paperboard sheet 10 reaches the printing position at which each of the inkjet heads 51 performs the printing. Thus, the control device 100 is operable, at the timing when the value of the printing instruction counter becomes zero, to output a printing instruction to the inkjet head 51. In response to this printing instruction, the inkjet head 51 is operable to discharge ink toward the corrugated paperboard sheet 10, to thereby print the individual identification information such as a serial number or a barcode, in the printing target site P1 on the corrugated paperboard sheet 10.

Basically, a positional relationship between the cutter 20 and the inkjet head 51 is fixed (distance L2 is constant). Thus, at a time when the cutter 20 performs the cutting, a positional relationship between the inkjet head 51 and the corrugated paperboard sheet 10 in the conveyance direction FW is determined, so that a relationship between the printing position at which the inkjet head 51 performs the printing and the printing target site P1 where the individual identification information is to be printed by the inkjet head 51 is uniquely determined.

The cut schedule is created in the above manner, because, every time the cutter 20 cuts the corrugated paperboard sheet 10, a position of a cut line along which the corrugated paperboard sheet 10 is to be cut by the cutter 20 next time is set based on a position of a cut line along which the corrugated paperboard sheet 10 is cut by the cutter 20 this time, i.e., while taking into account an error of the latest cutting by the cutter 20 (a deviation in cut position), thereby preventing an influence of a deviation in cut position from being accumulated.

Next, with reference to FIG. 9, a flow of the printing control for each of the inkjet units 50 of the printer 18 to be performed by the control device 100 in the first embodiment will be specifically described. FIG. 9 is a flowchart depicting a printing control processing routine in the first embodiment.

An outline of this flow is described briefly as follows. The processing routine of steps S101 to S104 is designed to preliminarily position each of the inkjet heads 51 in one selected from the upstream-side inkjet unit set and the downstream-side inkjet unit set, as an inkjet unit set to be used during the next order (in other words, one of the upstream-side inkjet unit set and the downstream-side inkjet unit set which is not used in the current order), in the up-down direction and in the width direction. Further, the processing routine of steps S105 to S110 is designed to perform the printing using the inkjet heads 51 of the inkjet unit set used in the current order, and the processing routine of steps S111 to S113 is designed to be executed after the order change.

First of all, in the step S101, the control device 100 creates use/non-use information for specifying ones of the plurality of inkjet heads 51 to be used for the printing and the remaining inkjet heads 51 to be not used for the printing, based on a content (division number, division width, etc.) of the next order, and determines respective width-directional positions of the plurality of inkjet heads 51. More specifically, with respect to each of the inkjet heads 51 of one selected from the upstream-side inkjet unit set and the downstream-side inkjet unit set, as an inkjet unit to be used in the next order, the control device 100 creates use/non-use information and determines a width-directional position thereof. In this case, based on a division number, a division width, etc., of the next order, and under a restriction that adjacent ones of the inkjet heads 51 are kept from interference with each other (in other words, under a restriction that a distance between adjacent ones of the inkjet heads 51 is kept from becoming a minimum interspace distance or less), the control device 100 determines to, with respect to each printing target location on a corrugated paperboard sheet 10, select and use one of the inkjet heads 51 which is located closest thereto. In regard to each of the inkjet heads 51 determined to be used, the control device 100 determines a width-directional position corresponding to the printing target location on the corrugated paperboard sheet 10. On the other hand, in regard to each of the inkjet heads 51 determined to be not used, the control device 100 determines a preliminarily-set appropriate width-directional position.

Subsequently, in the step S102, the control device 100 operates to position each of the plurality of inkjet heads 51 of the inkjet unit set to be used in the next order, at a target up-down directional position. In this case, the control device 100 controls the up-down moving motor 52*b* of the up-down moving mechanism 52 in each of the inkjet units 50, via the up-down servo driving unit 102, to thereby move the inkjet head 51 in the up-down direction.

More specifically, the control device 100 operates to position the inkjet head 51 at an up-down directional position appropriate to a larger one of a thickness of a corrugated paperboard sheet 10 being manufactured in the current order, and a thickness of a corrugated paperboard sheet 10 to be manufactured in the next order. The reason is as follows. In the case where a corrugated paperboard sheet 10 according to the current order has a thickness greater than that of a corrugated paperboard sheet 10 according to the next order, each inkjet head 51 to be used in the next order is positioned at an up-down directional position appropriate to a thickness of the corrugated paperboard sheet 10 according to the current order, to thereby prevent a distal end of the inkjet head 51 from coming into contact with the corrugated paperboard sheet 10 according to the current order. On the other hand, in the case where a corrugated paperboard sheet 10 according to the next order has a thickness greater than that of a corrugated paperboard sheet 10 according to the current order, each inkjet head 51 to be used in the next order is positioned at an up-down directional position appropriate to a thickness of the corrugated paperboard sheet 10 according to the next order, to thereby eliminate a need to position the inkjet head 51 at a new up-down directional position again in the next order.

Subsequently, in the step S103, the control device 100 operates to position each of the plurality of inkjet heads 51 of the inkjet unit set to be used in the next order, at the width-directional position determined in the step S101. In this case, the control device 100 controls the width-direction moving motor 54*d* of the width-direction moving mechanism 54 in each of the inkjet units 50, via the width-direction servo driving unit 104, to thereby move the inkjet unit 50 in the width direction.

Subsequently, in the step S104, the control device 100 assigns one of the use/non-use information determined in the step S101, to each of the inkjet heads 51 of the inkjet unit set to be used in the next order. Then, with respect to each of the inkjet heads 51 assigned with "use" in the use/non-use information, the control device 100 sets an initial value of a serial number to be printed (printing initial value), and sets a value (incremental value) by which the serial number is incremented, every time the printing is completed. Basically, the control device 100 uses, as this incremental value, a value of the division number (e.g., in the case where the division number is three, the incremental value is set to "3", or in the case where the division number is four, the incremental value is set to "4"). In one example, in the case where the division number is three, the number of the inkjet heads 51 to be used is three, wherein: a first one of the three inkjet heads 51 is operable to print the serial number, e.g., in the following manner: "101, 104, 107, - - - "; a second one of the remaining inkjet heads 51 located next to the first inkjet head 51 is operable to print the serial number, e.g., in the following manner: "102, 105, 108, - - - "; and the last inkjet head 51 located next to the second inkjet head 51 is operable to print the serial number, e.g., in the following manner: "103, 106, 109, - - - ".

Subsequently, in the step S105, the control device 100 determines whether or not the cutter 20 has cut the corrugated paperboard sheet 10. In this case, the control device 100 acquires a cutter cutting signal indicative of the presence or absence of execution of cutting by the cutter 20, and determines whether or not the cutter cutting signal has switched from an OFF state to an ON state. As a result, when the cutter cutting signal has switched to the ON state (step S105: YES), the processing routine proceeds to the step S106. On the other hand, when the cutter cutting signal has not switched to the ON state (step S105: NO), the processing routine skips to the step S111.

In the step S106, based on the cut schedule indicative of a position of a cut line along which the corrugated paperboard sheet 10 is subsequently cut, and the like, the control device 100 calculates and sets, on the corrugated paperboard sheet 10, a printing target site P1 where the individual identification information is to be subsequently printed by the inkjet head 51, and sets the printing instruction counter to a value according to the printing target site P1. More specifically, the control device 100 sets the printing instruction counter to a value corresponding to the distance L3 between a position of a leading edge of the printing target site P1 set on the corrugated paperboard sheet 10, and the printing position at which each of the inkjet heads 51 performs the printing (see FIG. 8).

Subsequently, in the step S107, based on a feed length signal received from the feed length sensor 25 after the cutter cutting signal has switched to the ON state, the control device 100 gradually decrements the value of the printing instruction counter. Then, in the step S108, the control device 100 determines whether or not the value of the printing instruction counter has become zero. As a result, when the value of the printing instruction counter has not become zero (step S108: NO), the processing routine returns to the step S107, wherein the control device 100 further decrements the value of the printing instruction counter. The control device 100 will repeat the processing in the steps S107 and S108 to decrement the value of the printing instruction counter until the value becomes zero.

On the other hand, when the value of the printing instruction counter has become zero (step S108: YES), the processing routine proceeds to the step S109. At this time, the corrugated paperboard sheet 10 is conveyed after the cutter 20 cuts the corrugated paperboard sheet 10, by a length corresponding to the distance L3 between the leading edge position of the printing target site P1 set on the corrugated paperboard sheet 10, and the printing position at which each of the inkjet heads 51 performs the printing. That is, the leading edge position of the printing target site P1 set on the corrugated paperboard sheet 10 reaches the printing position at which each of the inkjet heads 51 performs the printing. Thus, at this timing, the control device 100 outputs a printing instruction to the inkjet head 51 (step S109). More specifically, the control device 100 outputs, to each of the inkjet heads 51, a printing instruction including a value (printing value) to be printed on the corrugated paperboard sheet 10 as a serial number representing the individual identification information. This printing value is a value obtained by repeatedly adding the incremental value to the initial value. Every time the incremental value is added, the printing value is updated, and the updated printing value is stored in a memory or the like.

Subsequently, in the step S110, the control device 100 adds the incremental value to the printing value printed in the step S109. The control device 100 updates the printing value used in the step S109, with a new printing value obtained by adding the incremental value, and stores the updated printing value in a memory or the like.

Subsequently, in the step S111, the control device 100 determines whether or not there is an order change. As a result, when there is no order change (Step S111: NO), the processing routine returns to the step S105. In this case, the control device 100 performs the processing in the steps S105 to S110 again to instruct each of the inkjet heads 51 to print the individual identification information (serial number) on the corrugated paperboard sheet 10. In this way, the control device 100 instructs each of the inkjet heads 51 to successively perform the printing until an order change.

On the other hand, when there is an order change (Step S111: YES), the processing routine proceeds to the step S112, wherein the control device 100 operates to position each of the plurality of inkjet heads 51 of the inkjet unit set to be used after the order change, at an up-down directional position appropriate to a thickness of a corrugated paperboard sheet 10 to be manufactured according to an order after the change. More specifically, the control device 100 operates to position each of the inkjet heads 51 at a position away upwardly from a position of a printing surface of the corrugated paperboard sheet 10 by a predetermined distance appropriate to the thickness of the corrugated paperboard sheet 10 (a distance between a distal end of the inkjet head 51 and the printing surface of the corrugated paperboard sheet 10, which is set so as to allow the inkjet head 51 to adequately perform the printing with respect to the printing surface). In the case where, in the aforementioned step S102, each of the inkjet head 51 is already positioned at the up-down directional position appropriate to the thickness of the corrugated paperboard sheet 10 according to the next order (this case corresponds to the case where a corrugated paperboard sheet 10 according to the next order has a thickness greater than that of a corrugated paperboard sheet 10 according to the current order), it is not necessary to newly perform positioning in the step S112.

Last of all, in the step S113, the control device 100 makes a shift to production according to the next order. After this, the processing routine returns to the step S101. Thus, the control device 100 will perform the processing in the step S101 and the subsequent steps again.

(Functions/Effects)

Next, functions/effects of the corrugated paperboard sheet manufacturing apparatus 1 according to the first embodiment will be described.

In the first embodiment, the individual identification information is printed on a corrugated paperboard sheet 10 by the printer 18, and a variety of information can be associated with the individual identification information, so that it becomes possible to enhance convenience of management for resulting corrugated paperboard sheets 10 and corrugated paperboard boxes formed from the corrugated paperboard sheets 10.

For example, from a viewpoint of allowing the individual identification information to be associated with production information (e.g., a glue-based bonded state between the corrugated medium 2 and the liner 4, accuracy in processed (machined) dimensions by the slitter 16, the scorer 14 and the cutter 20, a machine operating speed, a heating temperature by a heater, and a machine adjustment state), a technique of printing the individual identification information on a corrugated paperboard sheet 10 during a manufacturing process of corrugated paperboard sheets 10, as in the first embodiment, is fairly efficient, as compared to a technique of printing the individual identification information on corrugated paperboard sheets during a box making process. Although the technique of performing printing of the individual identification information during a box making process is inefficient because of difficulty in performing collation between a corrugated paperboard sheet 10 for which a box making process is performed, and a corrugated paperboard sheet 10 in a preceding corrugated paperboard sheet manufacturing process, the technique of performing the printing of the individual identification information during a manufacturing process of corrugated paperboard sheets 10 (corrugated paperboard sheet manufacturing process) is efficient because of easiness in associating production information about a corrugated paperboard sheet 10 with the individual identification information.

In the first embodiment, the printer 18 is disposed downstream of the double facer 12, so that it becomes possible to avoid a situation where a printed surface is abraded by a surface of a heating plate of a double facer (13) in an apparatus (e.g., an apparatus described in the Patent Document 2) in which a printer (16) is disposed upstream of the double facer (13), and thus prevent deterioration in printing quality.

Particularly, in the first embodiment, the printer 18 is disposed between the scorer 14 and the slitter 16, so that it becomes possible to perform the printing on a corrugated paperboard sheet 10 in a state in which it is pressed by respective processing (machining) operations of the scorer 14 and the slitter 16, so as to be kept from displacement of the corrugated paperboard sheet 10 in the width direction. In this state, accuracy in conveyance of the corrugated paperboard sheet 10 is high, more specifically, width-direction displacement of the corrugated paperboard sheet 10 during conveyance is suppressed, so that it becomes possible to ensure printing accuracy in the cross direction of the corrugated paperboard sheet 10. That is, it becomes possible to suppress printing misalignment in the cross direction.

Additionally, in the first embodiment, the printing is performed at a position close to a position in which scoring and slitting are performed, respectively, by the scorer 14 and the slitter 16, so that it becomes possible to effectively suppress a deviation in a dimension between the processing (machining) position and the printing position.

In the first embodiment, the printer 18 is configured to perform the ink-jet printing on a corrugated paperboard sheet 10 in a non-contact state without any need for a printing plate, so that it becomes possible to change a content of the individual identification information easily and adequately during manufacturing of corrugated paperboard sheets 10, as compared to an apparatus (e.g., the apparatus described in the Patent Document 2) configured to perform printing using a printing plate.

In the first embodiment, every time the cutter 20 cuts a corrugated paperboard sheet 10, a printing target location (printing target site P1) is set on the corrugated paperboard sheet 10, so that it becomes possible to suppress an influence of an error in cutting by the cutter 20 on the printing target location. More specifically, it becomes possible to suppress the occurrence of a situation where, due to an influence of accumulated deviations in cutting position occurring during the cutting performed plural times, a printing target location is largely deviated in the conveyance direction.

In the first embodiment, the printing is performed at a timing when a corrugated paperboard sheet 10 is conveyed by a length corresponding to the distance L3 between the printing target location set on the corrugated paperboard sheet 10 and the printing position at which each of the inkjet heads 51 of the printer 18 performs the printing, so that it becomes possible to adequately print the individual identification information in the printing target location set on the corrugated paperboard sheet 10.

In the first embodiment, every time the individual identification information is printed in the form of a serial number, a number obtained by adding a value corresponding to the division number to a number corresponding to the printed individual identification information is set with respect to each of the inkjet heads 51 to be used for the printing, as new individual identification information to be subsequently printed, so that it becomes possible to print consecutive numbers to the corrugated paperboard sheet 10 to be manufactured, sequentially and adequately.

In the first embodiment, each of the plurality of inkjet heads 51 arranged side-by-side in the width direction is configured to be moved in the up-down direction and the width direction, so that it becomes possible to adequately and quickly cope with changes in the division number, a thickness of the corrugated paperboard sheet 10, the printing target position where the individual identification information is to be printed on the corrugated paperboard sheet 10, and the like.

In the first embodiment, the two inkjet unit sets (upstream-side and downstream-side inkjet unit sets) are arranged along the conveyance direction FW (arranged in tandem), so that it becomes possible to adequately cope with an increase in production speed of corrugated paperboard sheets 10, an increase in number of times of order change, and the like.

(Modifications)

Some modifications of the first embodiment will be described below.

In the first embodiment, the printer 18 is disposed between the scorer 18 and the slitter 16. However, the present invention is not limited thereto. For example, the printer 18 may be disposed at a position on an upstream side of and adjacent to the scorer 14 or may be disposed at a position on a downstream side of and adjacent to the slitter 16. That is, the printer 18 may be disposed in adjacent relation to the scorer 14 and/or the slitter 16. As above, the printer 18 may be disposed in adjacent relation to the scorer 14 and/or the slitter 16. In this case, it becomes possible to perform the printing on a corrugated paperboard sheet 10 in a state in which it is pressed by a processing (machining) operation of the scorer 14 and/or the slitter 16, so as to be kept from displacement of the corrugated paperboard sheet 10 in the width direction, thereby ensuring printing accuracy in the width direction of the corrugated paperboard sheet 10. From this point of view, the installation position of the printer 18 adjacent to the scorer 14 and/or the slitter 16 is preferably set in a range within which the processing (machining) operation of the scorer 14 and/or the slitter 16 has an effect of pressing the corrugated paperboard sheet 10 so as to keep it from being displaced in the width direction.

In the first embodiment, a serial number and a barcode are shown as the individual identification information. Alternatively, various marks and corded patterns may be used as the individual identification information.

In the first embodiment, a length by which a corrugated paperboard sheet 10 is conveyed (fed) is detected using the feed length sensor 25 which is a contact type sensor (e.g., a measuring roll) configured to detect the length while being keep in contact with the corrugated paperboard sheet 10. Alternatively, it is possible to use a non-contact type feed length sensor (sensor using laser or the like) configured to detect the length without a contact with the corrugated paperboard sheet 10. As another alternative, a length by which a corrugated paperboard sheet 10 is conveyed (fed) may be detected using a pulse generator capable of detecting a distance by which a conveyer belt is moved, or the like.

In the first embodiment, the inkjet heads 51 of the printer 18 are arranged just above a corrugated paperboard sheet 10 being conveyed. In this embodiment, the individual identification information is printed on an upper surface of the corrugated paperboard sheet 10 being conveyed. In this case, the individual identification information printed on a resulting corrugated paperboard sheet 10 will be located inside a corrugated paperboard box formed from the corrugated paperboard sheet 10. Alternatively, instead of or in addition to arranging the inkjet heads 51 just above the corrugated paperboard sheet 10 being conveyed, the inkjet heads 51 may be arranged just below the corrugated paperboard sheet 10 being conveyed. Each of the inkjet heads 51 arranged just below the corrugated paperboard sheet 10 is operable to print the individual identification information on a lower surface of the corrugated paperboard sheet 10 being conveyed. The individual identification information printed on a lower surface of a resulting corrugated paperboard sheet 10 will be located outside a corrugated paperboard box formed from the corrugated paperboard sheet 10.

Second Embodiment

Next, a corrugated paperboard sheet manufacturing apparatus according to a second embodiment of the present invention will be described.

The following description will be made primarily about a configuration and control different from those in the first embodiment. Thus, description about the same configuration and control as those in the first embodiment will be appropriately omitted (The same element or component as that in the first embodiment is assigned with the same reference sign). It should be noted that any non-described part of configuration and control in the following description is the same as that in the first embodiment.

Figure 10:
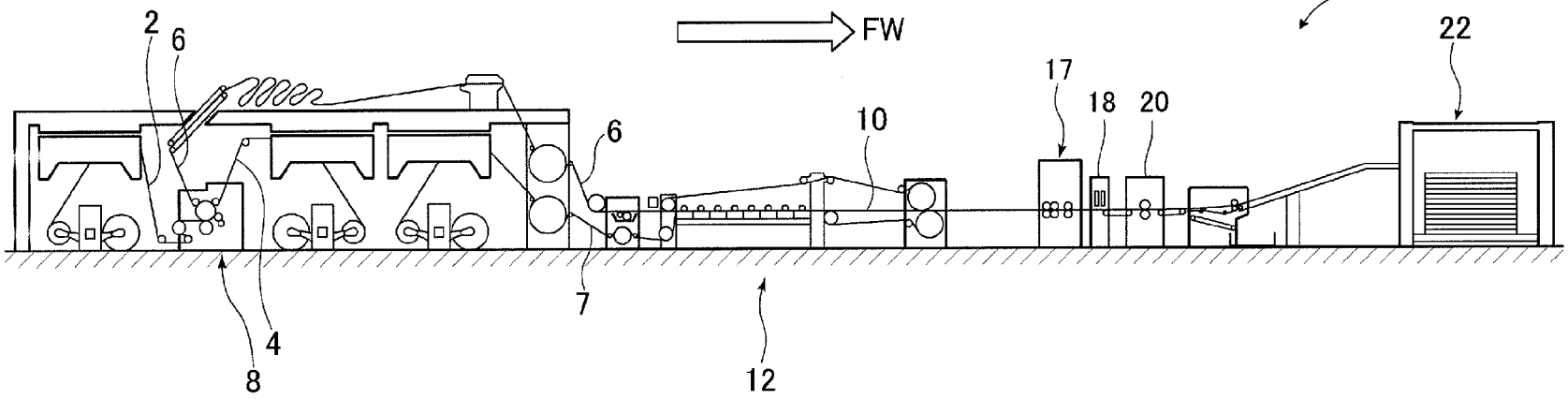
FIG. 10 is a side view depicting the entirety of a corrugated paperboard sheet manufacturing apparatus according to a second embodiment of the present invention.

With reference to FIG. 10, an overall configuration of the corrugated paperboard sheet manufacturing apparatus according to the second embodiment will be described. FIG. 10 is a side view depicting the entirety of the corrugated paperboard sheet manufacturing apparatus according to the second embodiment.

In the corrugated paperboard sheet manufacturing apparatus 1 according to the first embodiment, the printer 18 is provided within the slitter-scorer 17, more specifically, between the scorer 14 and the slitter 16. In the corrugated paperboard sheet manufacturing apparatus 1*a* according to the second embodiment, a printer 18 is provided between a slitter-scorer 17 and a cutter 20, as depicted in FIG. 10.

A configuration of the printer 18 itself is the same as that in the first embodiment (see FIGS. 3 to 6B). The contents of control for the printer 18 to be performed by the control device 100 are the same as those in the first embodiment (see FIGS. 7 to 9).

The corrugated paperboard sheet manufacturing apparatus according to the second embodiment can obtain the same functions/effects as those of the corrugated paperboard sheet manufacturing apparatus according to the first embodiment (see the section "(Functions/Effects)" in the description about the first embodiment).

Particularly, in the second embodiment, the printer 18 is disposed between the slitter-scorer 17 and the cutter 20, more specifically, disposed on an upstream side of and in adjacent relation to the cutter 20, so that it becomes possible to suppress the occurrence of a situation where a printing target location is influenced by disturbances, such as an error in cutting by the cutter 20 (deviation in cutting position), and cut-off of a defective portion (which can randomly occur) of a corrugated paperboard sheet 10, which is commonly performed on a downstream side of the cutter 20. Thus, it becomes possible to ensure printing accuracy in the conveyance direction FW of the corrugated paperboard sheet 10. That is, it becomes possible to suppress printing misalignment in the conveyance direction FW.

Third Embodiment

Next, a corrugated paperboard sheet manufacturing apparatus according to a third embodiment of the present invention will be described.

The following description will be made primarily about a configuration and control different from those in the first and second embodiments. Thus, description about the same configuration and control as those in the first and second embodiments will be appropriately omitted (The same element or component as that in the first embodiment is assigned with the same reference sign). It should be noted that any non-described part of configuration and control in the following description is the same as that in the first embodiment.

(Apparatus Configuration)

Figure 11:
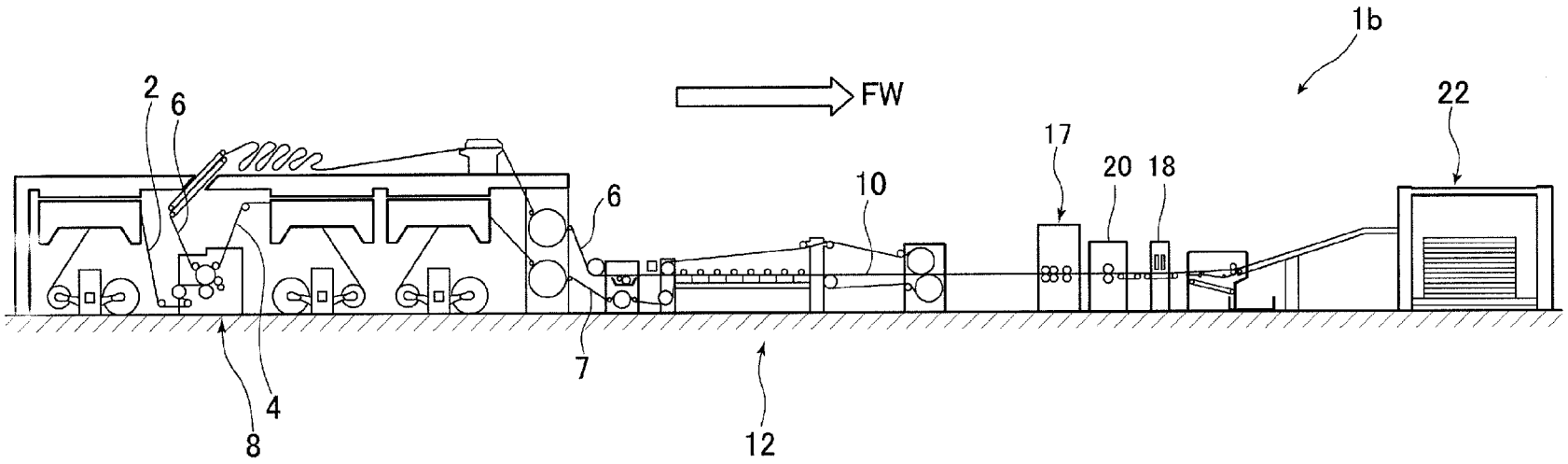
FIG. 11 is a side view depicting the entirety of a corrugated paperboard sheet manufacturing apparatus according to a third embodiment of the present invention.

FIG. 11 is a side view depicting the entirety of the corrugated paperboard sheet manufacturing apparatus according to the third embodiment. In the corrugated paperboard sheet manufacturing apparatus 1*a* according to the second embodiment, the printer 18 is provided on the upstream side of the cutter 20 (more specifically, between the slitter-scorer 17 and the cutter 20 and on the upstream side and in adjacent relation to the cutter 20). In the corrugated paperboard sheet manufacturing apparatus 1*b* according to the third embodiment, a printer 18 is provided on a downstream side a cutter 20, as depicted in FIG. 11. More specifically, in the third embodiment, the printer 18 is provided between the cutter 20 and a stacker 22 and on the downstream side of and in adjacent relation to the cutter 20. A configuration of the printer 18 itself is the same as that in the first embodiment (see FIGS. 3 to 6B).

Figure 12:
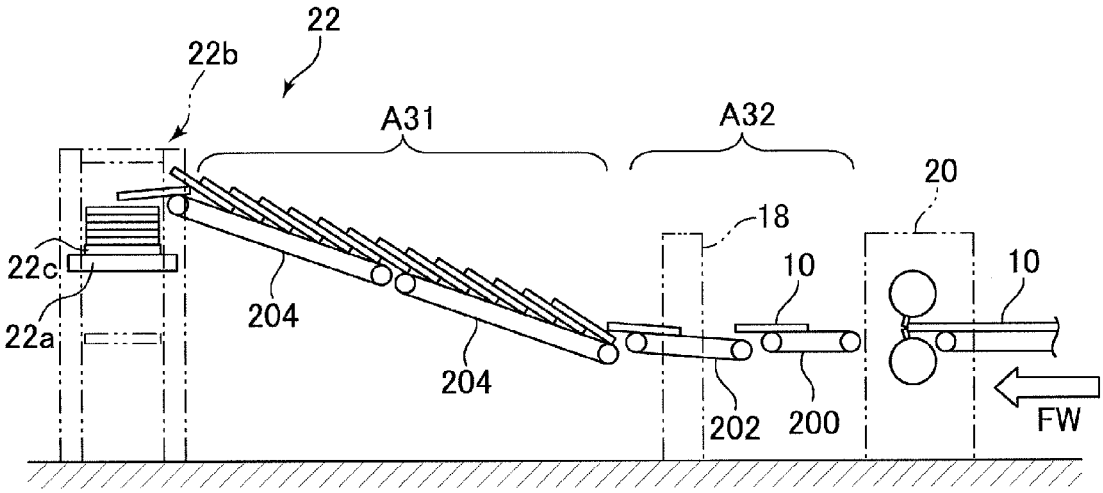
FIG. 12 is a schematic side view depicting a cutter and a stacker of the corrugated paperboard sheet manufacturing apparatus according to the third embodiment.

Next, with reference to FIG. 12, an installation position of the printer in the third embodiment will be specifically described. FIG. 12 is a schematic side view depicting the cutter and the stacker of the corrugated paperboard sheet manufacturing apparatus according to the third embodiment. In FIG. 12, the stacker 22 is depicted as an example of a stacker constructed as a so-called "down-stacker".

As depicted in FIG. 12, a plurality of corrugated paperboard sheets 10 cut off by the cutter 20 are sequentially conveyed by a plurality of conveyers 200, 202, 204. More specifically, a leading one of the corrugated paperboard sheets 10 cut off by the cutter 20 is first introduced onto the conveyer 200 and accelerated thereon to form a certain distance with respect to a subsequent, adjacent one of the corrugated paperboard sheets 10. Subsequently, the leading corrugated paperboard sheet 10 is decelerated on the conveyer (suction conveyer) 202 which is configured to suction-hold a corrugated paperboard sheet 10 on a conveyance surface thereof, and then introduced onto the conveyer 204. The conveyer (so-called "singling conveyer") 204 is inclined upwardly toward the conveyance direction FW (inclination angle: constant), and driven at a speed less than that of the conveyer 202. The corrugated paperboard sheets 10 discharged from the conveyer 202 are received by the conveyer 204 in such a manner adjacent ones thereof are partially superposed on each other, and conveyed along a rising slope of the conveyer 204 while being kept in the posture.

Preferably, a plurality of leaf springs are provided above the conveyers 200, 202 to bias the corrugated paperboard sheets 10 being conveyed by the conveyers 200, 202, downwardly. Although, for the sake of explanation, FIG. 12 depicts four conveyers 200, 202, 204 in total, as representative examples from a functional viewpoint of a conveyer to be provided on the downstream side of the cutter 20, it should be understood that such a conveyer may be provided in a number of four or more.

Each of the corrugated paperboard sheets 10 sequentially conveyed by the conveyer 204 to reach an exit of the conveyer 204 is received by a lifter table 22*a* of the stacker 22. This lifter table 22*a* is provided in such a manner as to be raisable and lowerable within a frame 22*b*, and configured to sequentially receive the corrugated paperboard sheets 10 discharged from the conveyer 204 while being lowered. Thus, the corrugated paperboard sheets 10 will be stacked on a pallet 22*c* placed on a top of the lifter table 22.

In the third embodiment, the printer 18 is disposed at a position in a region of a conveyance line where at least one of the corrugated paperboard sheets 10 is conveyed in a state in which it has not yet been partially superposed with another, as indicated by the reference sign A32 in FIG. 12 (see the broken line). More specifically, the printer 18 is disposed at a position of one of the conveyers 200, 202 (particularly, at a position of one of the conveyers 200, 202, except for a region across the two conveyers 200, 202).

It should be noted that the stacker 22 in the third embodiment is not limited to a down-stacker in which the inclination angle of the conveyer 204 for conveying the corrugated paperboard sheets 10 cut off by the cutter 20 is fixed, but may be an up-stacker in which an inclination angle of a conveyer for conveying the corrugated paperboard sheets 10 cut off by the cutter 20 is variable.

(Contents of Control)

Figure 13:
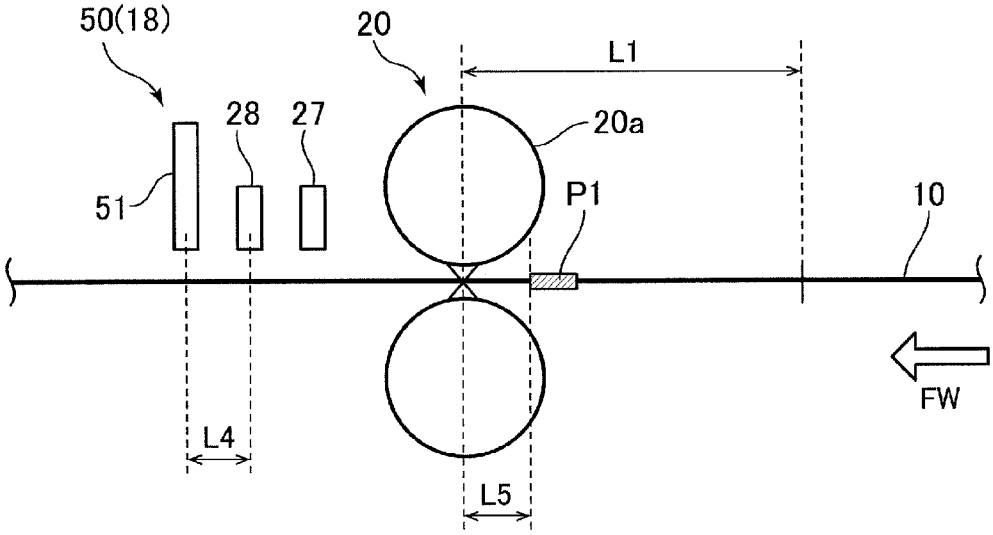
FIG. 13 is an explanatory diagram illustrating an outline of printing control for an inkjet unit of a printer to be performed by a control device in the third embodiment.
Figure 14:
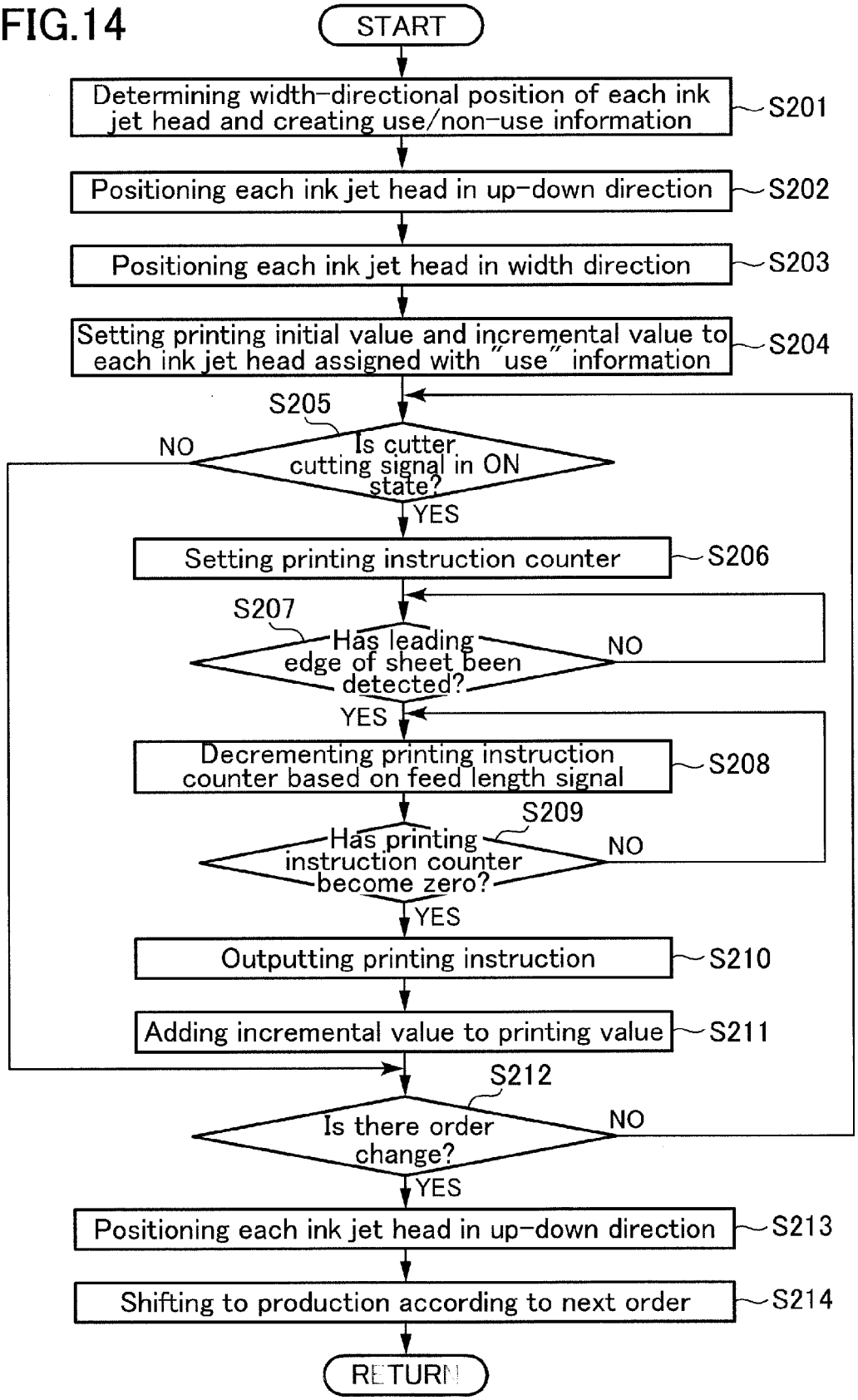
FIG. 14 is a flowchart depicting a printing control processing routine in the third embodiment.

Next, with reference to FIGS. 13 and 14, contents of control to be performed in the third embodiment will be specifically described. In the third embodiment, a control device 100 operates to control a plurality of inkjet units 50 of the printer 19, as with the first embodiment (see FIG. 7).

FIG. 13 is an explanatory diagram of an outline of control (printing control) for a plurality of inkjet heads 51 of the printer 18 to be performed by the control device 100 in the third embodiment. FIG. 13 is a side view schematically depicting one of the inkjet heads 51 of the printer 18 and the cutter 20.

In FIG. 13, the reference sign 27 denotes a feed length sensor for detecting a length by which a corrugated paperboard sheet 10 cut off by the cutter 20 is conveyed (fed), and the reference sign 28 denotes a sensor (leading edge detection sensor) 28 for detecting an leading edge of a corrugated paperboard sheet 10 cut off by the cutter 20. Each of the feed length sensor 27 and the leading edge detection sensor 28 is configured to perform detection in a non-contact state with the corrugated paperboard sheet 10 by using laser or the like. Each of the feed length sensor 27 and the leading edge detection sensor 28 is provided on an upstream side of the inkjet head 51 of the printer 18, and the leading edge detection sensor 28 is provided on a downstream side of the feed length sensor 27. More specifically, the leading edge detection sensor 28 is provided on the upstream side of a printing position where the inkjet head 51 performs printing, by a distance L4.

In the third embodiment, the control device 100 is operable, at a timing when the cutter 20 cuts a corrugated paperboard sheet 10, to set, on the corrugated paperboard sheet 10, a site away by a predetermined distance L5 from a leading edge of the corrugated paperboard sheet formed by the cutting (the predetermined distance L5 is a distance between a position of the leading edge of the corrugated paperboard sheet 10 and a position on the corrugated paperboard sheet 10 at which the individual identification information is to be printed, e.g., a distance included in a content of a production order or derivable from the content of the production order), as a printing target site P1 where the individual identification information is to be printed by the inkjet head 51 of the printer 50. Then, the control device 100 is operable to set a counter (printing instruction counter) to a value corresponding to a length (L4+L5) obtained by adding a distance L4 between a sensing position where the leading edge detection sensor 28 performs sensing, and a printing position where the inkjet head 51 performs the printing, to the predetermined distance L5 defining the printing target site P1. A relationship between the length (L4+L5) and the value of the printing instruction counter is equivalent to a relationship between an actual length by which the corrugated paperboard sheet 10 is conveyed (fed) and a value corresponding to a feed length signal from the feed length sensor 27.

Then, the control device 100 is operable, at a timing when the leading edge detection sensor 28 detects the leading edge of a corrugated paperboard sheet 10 cut off by the cutter 20 just after setting the printing instruction counter in the above manner, to start to decrement the value of the printing instruction counter set in the above manner. The control device 100 is operable to decrement the value of the printing instruction counter according to the feed length signal from the feed length sensor 27. As a result, the value of the printing instruction counter finally becomes zero. A timing when the value of the printing instruction counter becomes zero corresponds to a timing when the corrugated paperboard sheet 10 is conveyed by the length (L4+L5) after the leading edge detection sensor 28 detects the leading edge, i.e., a timing when a position of a leading edge of the printing target site P1 on the corrugated paperboard sheet 10 reaches the printing position at which each of the inkjet heads 51 performs the printing. Thus, the control device 100 is operable, at the timing when the value of the printing instruction counter becomes zero, to output a printing instruction to the inkjet head 51. In response to this printing instruction, the inkjet head 51 is operable to discharge ink toward the corrugated paperboard sheet 10, to thereby print the individual identification information such as a serial number or a barcode, in the printing target site P1 on the corrugated paperboard sheet 10.

In the first and second embodiments, the contact type feed length sensor 25 is used. Differently, in the third embodiment, the non-contact type feed length sensor 27 is used, because on the downstream side of the cutter 20, the corrugated paperboard wed 10 is cut into discontinuous sheets, and therefore a feed length of such a corrugated paperboard sheet 10 cannot be accurately detected by the contact type feed length sensor 25 such as a measuring roll. More specifically, on the downstream side of the cutter 20, a certain distance is formed between adjacent sheets in the conveyance direction FW, i.e., there occurs a situation where the contact type feed length sensor 25 is not engaged with any corrugated paperboard sheet 10, and, even in this situation, the feed length sensor 25 is likely to continuously output the feed length signal indicative of conveyance of a target corrugated paperboard sheet 10 (due to, for example, a phenomenon that the measuring roll is rotated by inertia), thereby leading to a problem that a feed length greater than an actual feed length of the corrugated paperboard sheet 10 is detected. Further, considering that an installation space on the downstream side of the cutter 20 is relatively small, the non-contact type feed length sensor 27 is employed because it can be constructed in a smaller size as compared to the contact type feed length sensor 25 such as a measuring roll.

Next, with reference to FIG. 14, a flow of a printing control for each of the inkjet units 50 of the printer 18 to be performed by the control device 100 in the third embodiment will be specifically described. FIG. 14 is a flowchart depicting a printing control processing routine in the third embodiment.

Processing in steps S201 to S205 and processing in steps S212 to S214 depicted in FIG. 14 are the same, respectively, as processing in the steps S101 to S105 and processing in the steps S111 to S113 depicted in FIG. 9, and therefore description thereof will be omitted. The following description will be made only about processing in steps S206 to S211.

The processing in the step S206 is performed when the cutter cutting signal has switched to the ON state (step S205: YES). In the step S206, the control device 100 sets, on the corrugated paperboard sheet 10, a site away by the predetermined distance L5 from a position of a leading edge of the corrugated paperboard sheet 10 formed by the cutting using the cutter 20, as the printing target site P1 where the individual identification information is to be to be printed by the inkjet head 51. Then, the control device 100 sets the printing instruction counter to a value corresponding to the length (L4+L5) obtained by adding the distance L4 between the sensing position of the leading edge detection sensor 28 and the printing position of the inkjet head 51 to the predetermined distance L5 (see FIG. 13).

Subsequently, in the step S207, the control device 100 determines whether or not a leading edge of a corrugated paperboard sheet 10 has been detected by the leading edge detection sensor 28. As a result, when the leading edge of the corrugated paperboard sheet 10 has not been detected (step S207: NO), the processing routine returns to the step S207, wherein the control device 100 performs the determination in the step S207. The control device 100 will repeat the determination in the step S207 until the leading edge of the corrugated paperboard sheet 10 is detected.

On the other hand, when the leading edge of the corrugated paperboard sheet 10 has been detected (step S207: YES), the processing routine proceeds to the step S208, wherein the control device 100 gradually decrements the value of the printing instruction counter, based on a feed length signal received from the feed length sensor 27 after the leading edge of the corrugated paperboard sheet 10 has been detected by the leading edge detection sensor 28. Then, in the step S209, the control device 100 determines whether or not the value of the printing instruction counter has become zero. As a result, when the value of the printing instruction counter has not become zero (step S209: NO), the processing routine returns to the step S208, wherein the control device 100 further decrements the value of the printing instruction counter. The control device 100 will repeat the processing in the steps S208 and S209 to decrement the value of the printing instruction counter until the value becomes zero.

On the other hand, when the value of the printing instruction counter has become zero (step S209: YES), the processing routine proceeds to the step S210. At this time, the corrugated paperboard sheet 10 is conveyed, after the leading edge detection sensor 28 has detected the leading edge, by the length (L4+L5). That is, the leading edge position of the printing target site P1 on the corrugated paperboard sheet 10 reaches the printing position at which each of the inkjet heads 51 performs the printing. Thus, at this timing, the control device 100 outputs a printing instruction to the inkjet head 51 (step S210). More specifically, the control device 100 outputs, to each of the inkjet heads 51, a printing instruction including a value (printing value) to be printed on the corrugated paperboard sheet 10 as a serial number representing the individual identification information. This printing value is a value obtained by repeatedly adding an incremental value to the aforementioned initial value. Every time the incremental value is added, the printing value is updated, and the updated printing value is stored in a memory or the like.

Subsequently, in the step S211, the control device 100 adds the incremental value to the printing value printed in the step S210. The control device 100 updates the printing value used in the step S210, with a new printing value obtained by adding the incremental value, and stores the updated printing value in a memory or the like. Subsequently, the control device 100 performs the processing in the step S212 and the subsequent steps in the same manner as that in the step S111 and the subsequent steps.

(Functions/Effects)

The corrugated paperboard sheet manufacturing apparatus according to the third embodiment can obtain the same functions/effects as those of the corrugated paperboard sheet manufacturing apparatus according to the first embodiment (see the section "(Functions/Effects)" in the description about the first embodiment).

More specifically, in the third embodiment, the printer 18 is disposed at a position on the downstream side of and adjacent to the cutter 20 (at a position on the downstream side of the cutter 20 and in a region of the conveyance line where at least one corrugated paperboard sheet 10 is conveyed in a state in which it has not yet been partially superposed with another), so that it becomes possible to suppress the occurrence of a situation where a printing target location is influenced by disturbances, such as an error in cutting by the cutter 20 (deviation in cutting position), and cut-off of a defective portion (which can randomly occur) of a corrugated paperboard sheet 10, which is commonly performed on a downstream side of the cutter 20. Thus, it becomes possible to ensure printing accuracy in the conveyance direction FW of the corrugated paperboard sheet 10. That is, it becomes possible to suppress printing misalignment in the conveyance direction FW.

Fourth Embodiment

Next, a corrugated paperboard sheet manufacturing apparatus according to a fourth embodiment of the present invention will be described.

The following description will be made primarily about a configuration and control different from those in the first to third embodiments. Thus, description about the same configuration and control as those in the first to third embodiments will be appropriately omitted (The same element or component as that in the first embodiment is assigned with the same reference sign). It should be noted that any non-described part of configuration and control in the following description is the same as that in the first embodiment.

(Apparatus Configuration)

Figure 15:
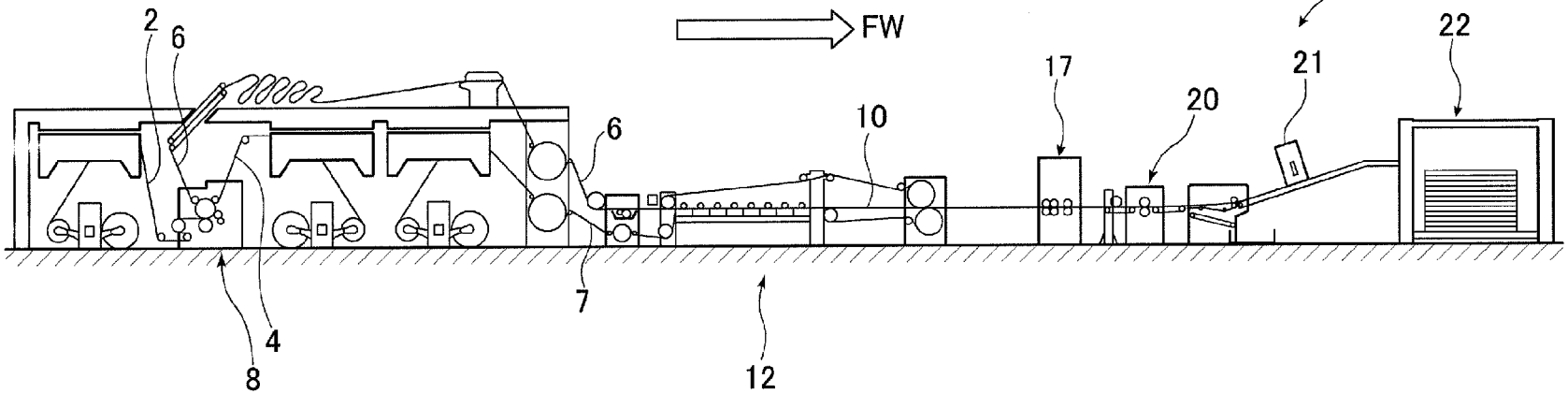
FIG. 15 is a side view depicting the entirety of a corrugated paperboard sheet manufacturing apparatus according to a fourth embodiment of the present invention.

FIG. 15 is a side view depicting the entirety of the corrugated paperboard sheet manufacturing apparatus according to the fourth embodiment. As depicted in FIG. 15, in the corrugated paperboard sheet manufacturing apparatus 1*c* according to the fourth embodiment, a printer 21 is provided on a downstream side a cutter 20, as with the corrugated paperboard sheet manufacturing apparatus 1*b* according to the third embodiment (see FIG. 11). However, in the fourth embodiment, the printer 21 is provided at a position on a further downstream side on a conveyance line of a corrugated paperboard sheet 10, as compared to the third embodiment.

Figure 16:
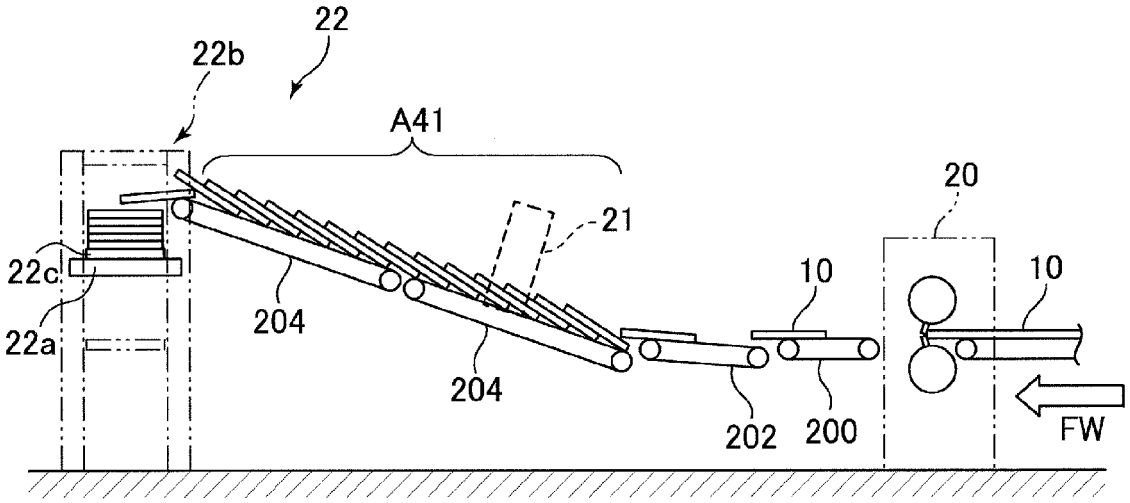
FIG. 16 is a schematic side view depicting a cutter and a stacker of the corrugated paperboard sheet manufacturing apparatus according to the fourth embodiment.

Next, with reference to FIG. 16, an installation position of the printer in the fourth embodiment will be specifically described. FIG. 16 is a schematic side view depicting the cutter and a stacker of the corrugated paperboard sheet manufacturing apparatus according to the fourth embodiment. In FIG. 16, a stacker 22 is depicted as an example of a stacker constructed as a so-called "down-stacker". In FIG. 16, the same element or component as that in FIG. 12 is assigned with the same reference sign, and description thereof will be omitted.

In the fourth embodiment, the printer 21 is disposed at a position in a region of a conveyance line where a plurality of corrugated paperboard sheets 10 are conveyed while being partially superposed on each other, as indicated by the reference sign A41 in FIG. 16 (see the broken line). More specifically, the printer 21 is disposed at a position of the conveyer 204. In the configuration exemplified in FIG. 16, the printer 21 is disposed at a position one of the two conveyers 204, except for a region across the two conveyers 294. It should be understood that the printer 21 may be disposed just above any conveyer, as long as it is capable of conveying a plurality of corrugated paperboard sheets 10 in a posture where they are partially superposed on each other.

Figure 17:
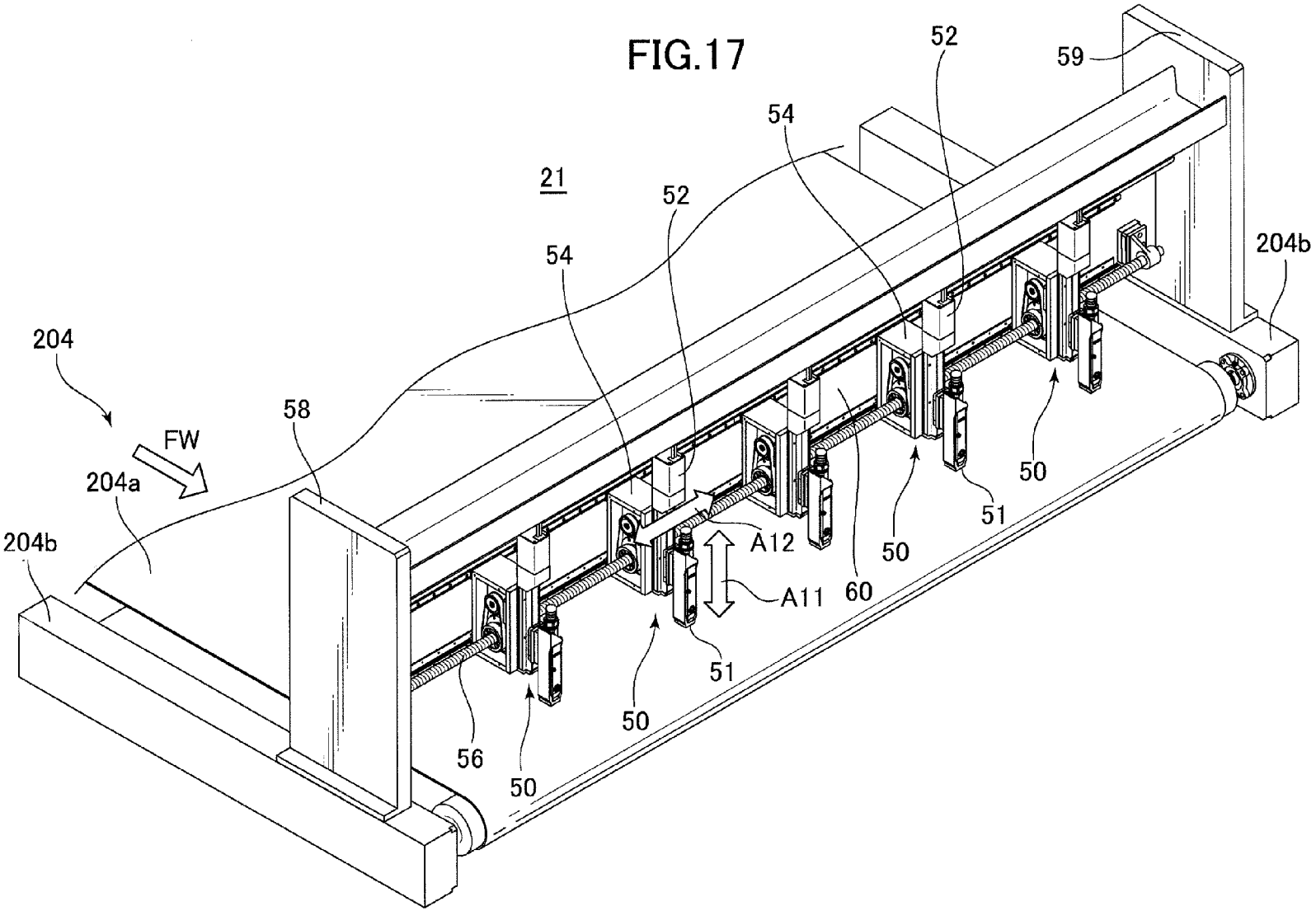
FIG. 17 is a perspective view depicting an overall configuration of a printer in the fourth embodiment.
Figure 18:
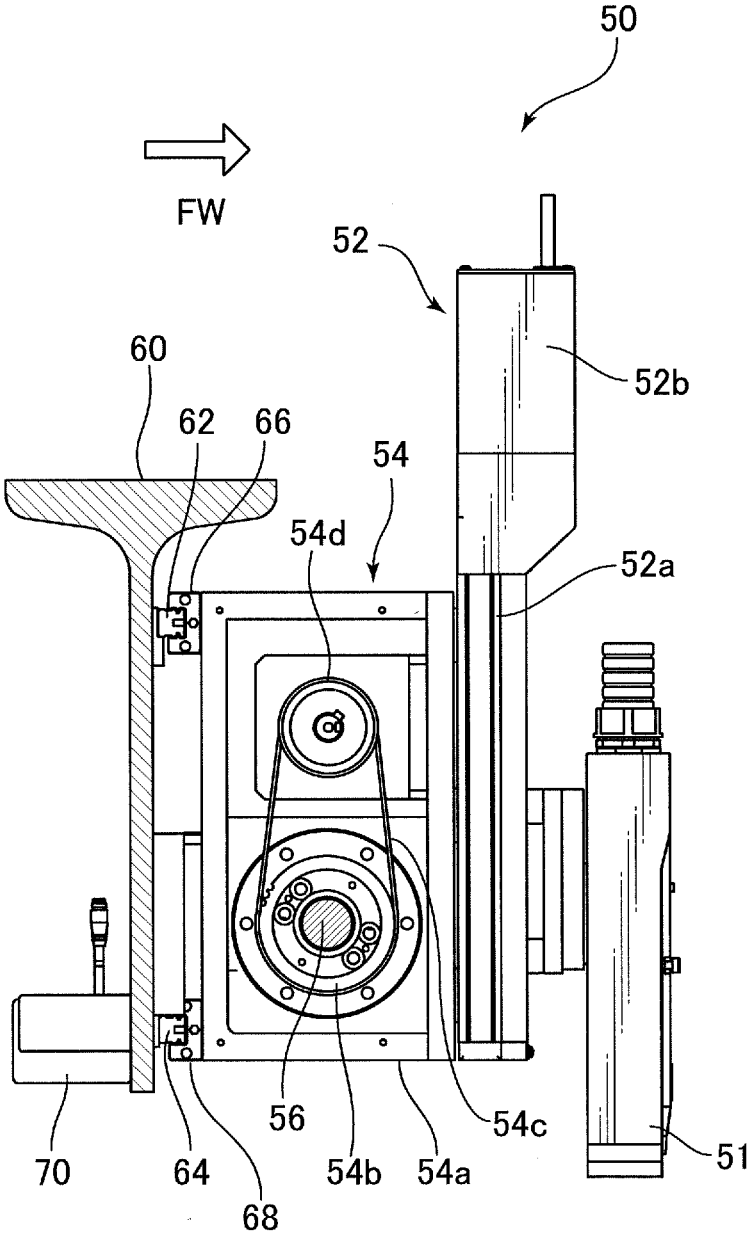
FIG. 18 is a side view of an inkjet unit of the printer in the fourth embodiment.

Next, with reference to FIGS. 17 and 18, a configuration of the printer in the fourth embodiment will be specifically described. FIG. 17 is a perspective view depicting an overall configuration of the printer in the fourth embodiment, and FIG. 18 is a side view of an inkjet unit of the printer in the fourth embodiment.

It should be noted that, although the printer 21 installed with respect to the conveyer 204 is actually inclined because the conveyer 204 is inclined upwardly toward a conveyance direction FW as depicted in FIG. 16, FIGS. 17 and 18 depict the conveyer 204 and the printer 31 in a horizontal posture only for the sake of explanation.

As depicted in FIG. 17, the printer 21 comprises an inkjet unit 50 having an inkjet head (inkjet nozzle) 51, wherein the inkjet unit 50 is provided to be located above a plurality of corrugated paperboard sheets 10 conveyed from the cutter 20. More specifically, in the printer 21 is bridged over the conveyer 204 in such a manner that two frames 58, 59 located at respective width-directionally opposite ends of the printer 21 are supported, respectively, by two frames 204*b* located at respective width-directionally opposite ends of the conveyer 204. The inkjet unit 50 of the printer 21 is provided plurally (more specifically, in a number of five), along a width direction of the printer 18, wherein the plurality of inkjet units 50 are configured to simultaneously perform printing on a plurality of corrugated paperboard sheets 10 conveyed from the cutter 20 while being arranged side-by-side in the width direction.

Basically, each of the inkjet unit 50 has the same configuration as that in the aforementioned embodiments (see, for example, FIGS. 4 and 5), except that, in the fourth embodiment, as depicted in FIG. 18, a height detection sensor 70 is fixed to a sidewall of a fixed member 60 on a side opposite to a sidewall to which the inkjet unit is fixed (i.e., on an upstream side), to detect a height position of a corrugated paperboard sheet 10 being conveyed. For example, the height detection sensor 70 is provided in a number of one at a width-directionally central position of the sidewall of the fixed member 60. It should be understood that two or more height detection sensor 70 may be used, wherein they may be provided at two or more positions on the sidewall of the fixed member 60 in width-directionally spaced-apart relation.

More specifically, the height detection sensor 70 is configured to emit a laser beam downwardly and output a signal corresponding to a distance from an object located just below the height detection sensor 70. This output signal is converted to information indicative of a height position of a corrugated paperboard sheet 10 on the conveyer 204 (strictly, a distance between an upper surface of a belt 204*a* of the conveyer 204 and an upper surface of the corrugated paperboard sheet 10. When there is not any corrugated paperboard sheet 10 on the conveyer 204 at a position just below the height detection sensor 70, the height detection signal obviously becomes zero. In the following description, a signal uniquely corresponding to the output signal of the height detection sensor 70 and indicative of the height position of the corrugated paperboard sheet 10 on the conveyer 204 will be appropriately referred to as "height detection signal". For example, this height detection signal is obtained by converting a signal directly output from the height detection sensor 70.

Figure 19:
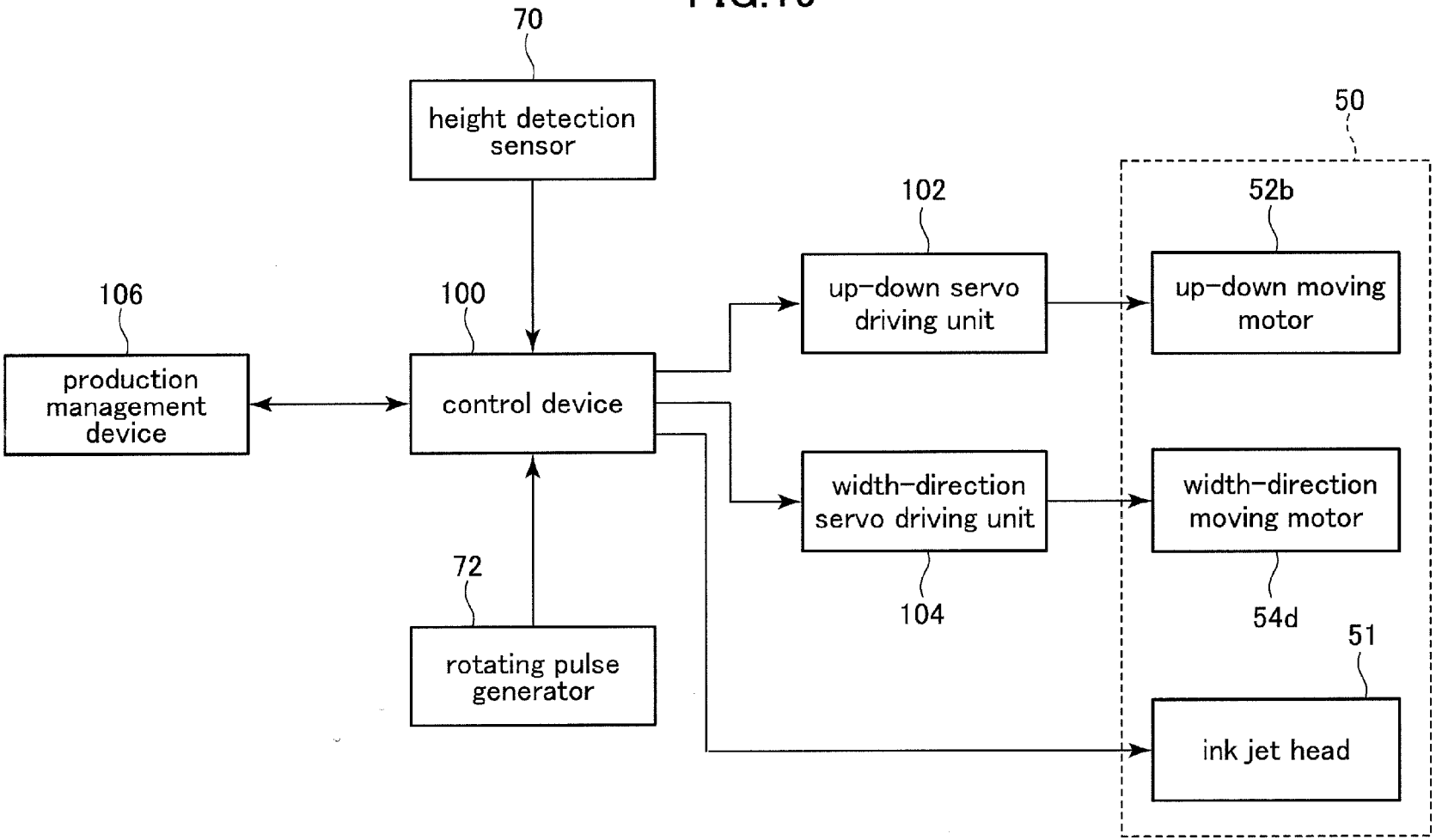
FIG. 19 is a block diagram depicting a control system for the inkjet unit of the printer in the fourth embodiment.

Next, with reference to FIG. 19, a control configuration of the printer in the fourth embodiment will be described. FIG. 19 is a block diagram depicting a control system for the inkjet unit of the printer in the fourth embodiment.

In the fourth embodiment, basically, a control unit 100 functions in the same manner as that in the aforementioned embodiments (see, for example, FIG. 7) to control each of the inkjet units 50 of the printer 21. Particularly, in the fourth embodiment, the control unit 100 is configured to receive an input of a signal output from the height detection sensor 70 (see FIG. 18) and a pulse signal output from a rotating pulse generator 72 provided in the conveyer 204, and, based on these signals, output a printing instruction to each of the inkjet heads 51. The rotating pulse generator 72 is configured to output a pulse signal according to rotation of a pulley for moving the belt 204*a* of the conveyer 204. The pulse signal is concerted to information indicative of a distance by which the belt 204*a* of the conveyer 204 is moved (corresponding to a movement distance of the corrugated paperboard sheet on the belt 204*a* of the conveyer 204). Details of control to be performed by the control device 100 will be described later.

(Contents of Control)

Figure 20:
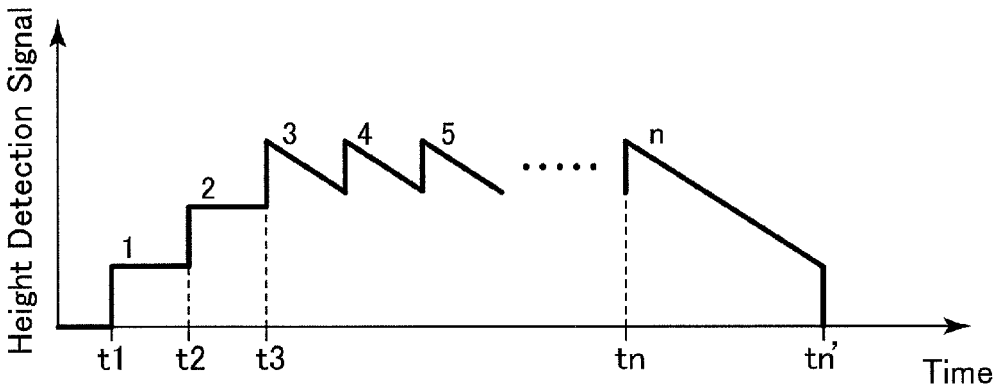
FIG. 20 is a time chart depicting one example of a height detection signal of a height detection sensor in the fourth embodiment.
Figure 21:
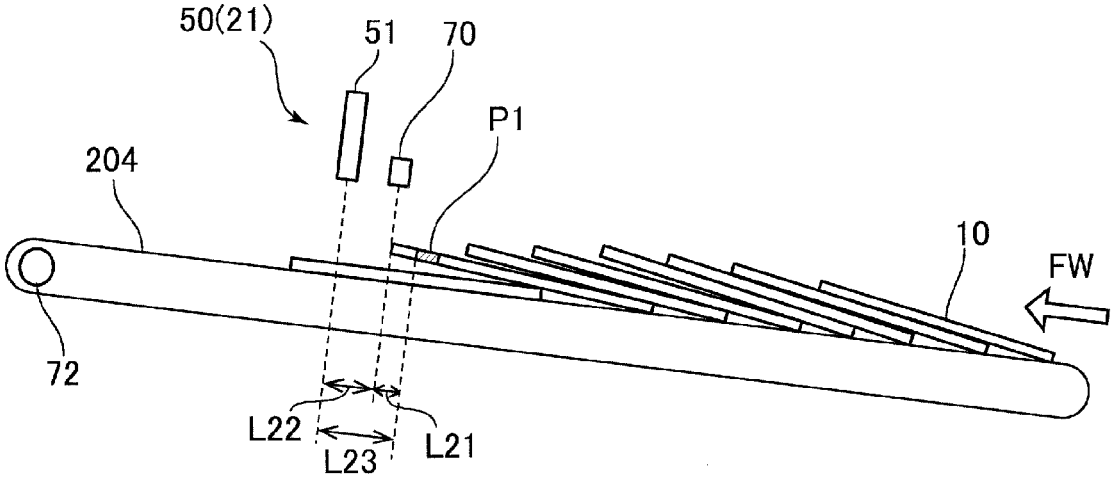
FIG. 21 is an explanatory diagram illustrating an outline of printing control for the inkjet unit of the printer to be performed by a control device in the fourth embodiment.
Figure 22:
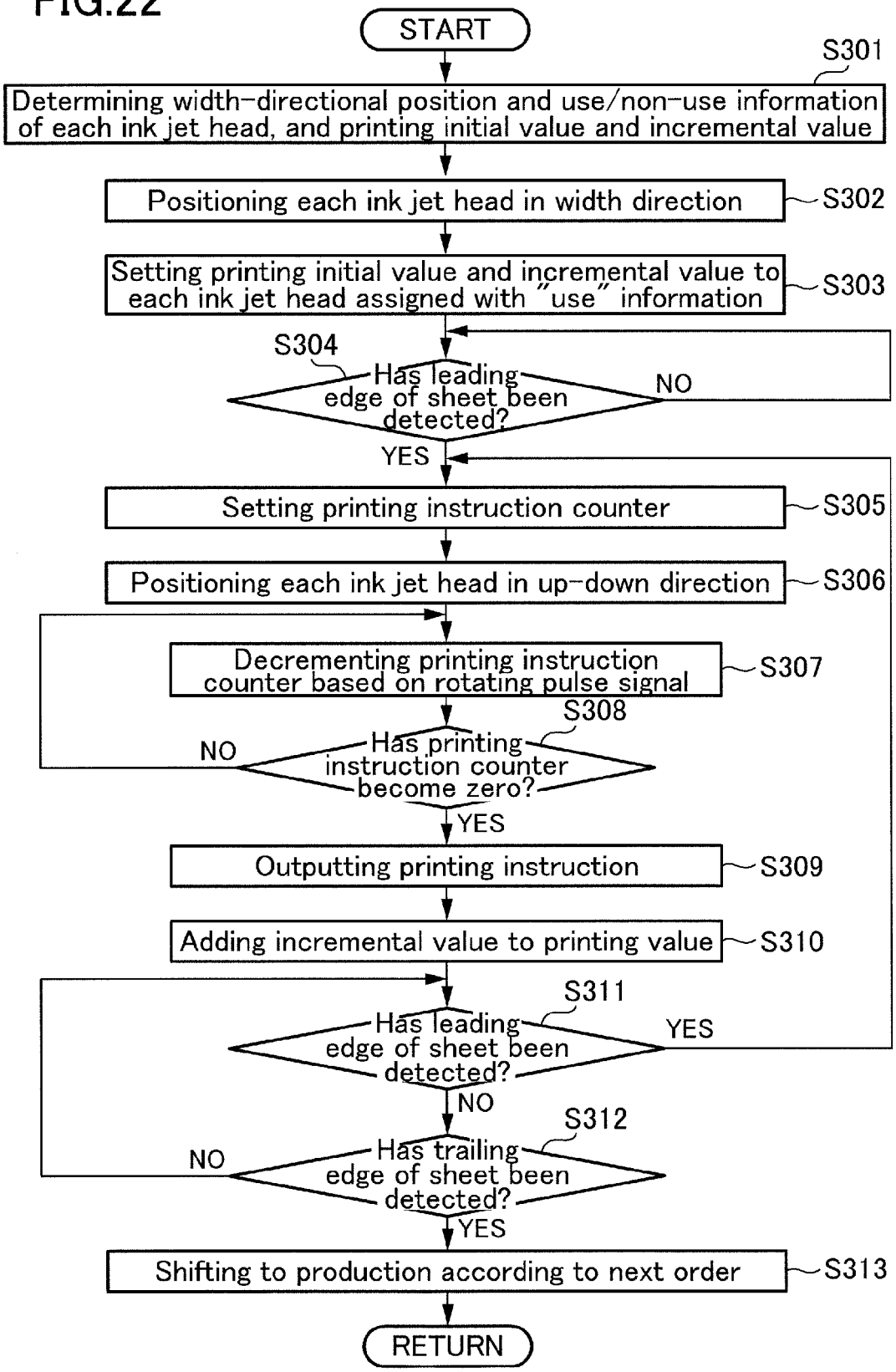
FIG. 22 is a flowchart depicting a printing control processing routine in the fourth embodiment.

Next, with reference to FIGS. 20 to 22, contents of control for each of the inkjet units 50 of the printer 21 to be performed by the control device 100 in the fourth embodiment will be specifically described.

In the fourth embodiment, the control device 100 is operable, based on the height detection signal from the height detection sensor 70, to detect a height position of each of a plurality of corrugated paperboard sheets 10 being conveyed on the conveyer 204, a leading edge of each of the corrugated paperboard sheets 10 being conveyed, and a trailing end of one of the corrugated paperboard sheets 10 (more specifically, a trailing edge of a rearmost one of a group of corrugated paperboard sheets 10) and, based on the detected data, perform control for each of the injector units 50 of the printer 21. First of all, with reference to FIG. 20, the height detection signal of the height detection sensor 70 will be specifically described.

As mentioned above, the control device 100 is operable, based on the height detection signal from the height detection sensor 70, to detect a height position of each of the corrugated paperboard sheets 10, a leading edge of each of the corrugated paperboard sheets 10, and a trailing end of one of the corrugated paperboard sheets 10. Thus, in the fourth embodiment, a combination of the control device 100 and the height detection sensor 70 is equivalent to "detection device" as set forth in the appended claims.

FIG. 20 is a time chart depicting one example of the height detection signal of the height detection sensor 70 in the fourth embodiment. As mentioned above, this height detection signal is indicative of a height position of a corrugated paperboard sheet 10 on the conveyer 204 (more specifically, a distance between the upper surface of the belt 204*a* of the conveyer 204 and the upper surface of the corrugated paperboard sheet 10).

As depicted in FIG. 20, when, according conveyance by the conveyer 204, a leading edge of a frontmost one of a group of corrugated paperboard sheets 10 (a group of corrugated paperboard sheets 10 manufactured under a common order) reaches a sensing position where the height detection sensor 70 performs sensing, the height detection signal rises from zero in a stepwise manner at time t1. A magnitude of the height detection signal at the time t1 corresponds to a thickness of one corrugated paperboard sheet 10.

Then, at time t2, a leading edge of a 2nd frontmost one of the group of corrugated paperboard sheets 10 reaches the sensing position of the height detection sensor 70, and thus the height detection signal further rises in a stepwise manner. At this time, the 2nd frontmost corrugated paperboard sheet 10 is partially superposed on the frontmost corrugated paperboard sheet 10, so that the height detection signal approximately corresponds to a thickness of two corrugated paperboard sheets 10.

Then, at time t3, a leading edge of a 3rd frontmost one of the group of corrugated paperboard sheets 10 reaches the sensing position of the height detection sensor 70, and thus the height detection signal further rises in a stepwise manner. At this time, the 3rd frontmost corrugated paperboard sheet 10 is partially superposed on the frontmost and 2nd frontmost corrugated paperboard sheets 10, so that the height detection signal approximately corresponds to a thickness of three corrugated paperboard sheets 10. Then, after the time t3, the detection signal gently lowers according to an inclination of the 3rd frontmost corrugated paperboard sheet 10. In regard to a 4th frontmost one to an nth frontmost (rearmost) one of the group of corrugated paperboard sheets 10, the detection signal changes in the same manner as the 3rd frontmost corrugated paperboard sheet 10.

When a leading edge of the rearmost (nth frontmost) one of the group of corrugated paperboard sheets 10 reaches the sensing position of the height detection sensor 70, the height detection signal rises in a stepwise manner at time tn, and subsequently the height detection signal gently lowers according to an inclination of the rearmost corrugated paperboard sheet 10. Then, at time tn', a trailing edge of the rearmost corrugated paperboard sheet 10 reaches the sensing position of the height detection sensor 70, and thereby the height detection signal falls toward zero in a stepwise manner.

Next, with reference to FIG. 21, an outline of control (printing control) for each of the inkjet heads of the printer 21 to be performed based on the height detection signal of the height detection sensor 70 by the control device 100 in the fourth embodiment will be described. FIG. 21 is a side view schematically depicting the inkjet head 51 of the printer 21 and the conveyer 204.

In the fourth embodiment, the control device 100 is operable, at a timing when a leading edge of each of the corrugated paperboard sheets is detected by the height detection sensor 70, to set, on the corrugated paperboard sheet, a printing target site P1 where the individual identification information is to be printed by the inkjet head 51 of the inkjet unit 50. More specifically, the control device 100 is operable, every time a leading edge of each of the corrugated paperboard sheets 10 is detected by the height detection sensor 70, to set, on the corrugated paperboard sheet 10, a site away by a predetermined distance L21 from the leading edge of the corrugated paperboard sheet (the predetermined distance L21 is a distance between a position of the leading edge of the corrugated paperboard sheet 10 and a position on the corrugated paperboard sheet 10 at which the individual identification information is to be printed, e.g., a distance included in a content of a production order or derivable from the content of the production order), as a printing target site P1 where the individual identification information is to be printed by the inkjet head 51. Then, the control device 100 is operable to set a counter (hereinafter referred to as "printing instruction counter") to a value corresponding to a length L23 (L23=L21+L22) obtained by adding a distance L22 between the sensing position of the height detection sensor 70 and the printing position of the inkjet head 51, to the predetermined distance L21 defining the printing target site P1. A relationship between the length L23 and the value of the printing instruction counter is equivalent to a relationship between an actual length by which the corrugated paperboard sheet 10 is conveyed (fed) and a value corresponding to a pulse signal from the rotating pulse generator 72.

In the case, the printing target site P1 is set within a non-superposed region (i.e., exposed region) of the corrugated paperboard sheet 10 where no corrugated paperboard sheet 10 is superposed thereon. In order to realize this, the printer 21 may be provided at a position just above a region of a conveyance line on which an area (e.g., a preliminarily-set fixed area) of the corrugated paperboard sheet 10 where the individual identification information is to be printed is never superposed with a subsequent corrugated paperboard sheet 10. Alternatively, the control device 100 may be configured to, with respect to a target corrugated paperboard sheet 10 for which the printing is performed, determine a region thereof which is not superposed with a subsequent corrugated paperboard sheet 10, and set a position within the determined region, as the printing target site P1. As a means to specifically determine such a non-superposed region, a laser beam-based height detection sensor or a detection sensor utilizing image processing may be used.

Then, the control device 100 is operable to gradually decrement the value of the printing instruction counter set in the above manner, according to the pulse signal from the rotating pulse generator 72, wherein the pulse signal is indicative of a distance by which the belt 204*a* of the conveyer 204 is moved (corresponding to a movement distance of a corrugated paperboard sheet 10 on the belt 204*a* of the conveyer 204). As a result, the value of the printing instruction counter finally becomes zero. A timing when the value of the printing instruction counter becomes zero corresponds to a timing when the corrugated paperboard sheet 10 is conveyed, after a leading edge of the corrugated paperboard sheet 10 is detected by the height detection sensor 70, by a length corresponding to the length L 23 between a position of a leading edge of the printing target site set on the corrugated paperboard sheet 10 and the printing position of the inkjet head 51, i.e., a timing when the leading edge position of the printing target site P1 on the corrugated paperboard sheet 10 reaches the printing position of the inkjet head 51. Thus, the control device 100 is operable, at the timing when the value of the printing instruction counter becomes zero, to output a printing instruction to the inkjet head 51. In response to this printing instruction, the inkjet head 51 is operable to discharge ink toward the corrugated paperboard sheet 10, to thereby print the individual identification information such as a serial number or a barcode, in the printing target site P1 on the corrugated paperboard sheet 10.

Subsequently, the control device 100 is operable, when a trailing end of the rearmost one of the group of corrugated paperboard sheets 10 is detected by the height detection sensor 70 (see the time tn' in FIG. 20), to determine that an order change has been made, and makes a shift to production according to the next order. The reason why a timing of an order change can be determined based on a timing of the detection of the trailing end of the rearmost one of the group of corrugated paperboard sheets 10 is as follows. In the group of corrugated paperboard sheets 10, adjacent ones of the corrugated paperboard sheets 10 in the conveyance direction FW are superposed on each other, and therefore a trailing edge of the fore-side corrugated paperboard sheet 10 is basically not exposed to outside because it is hidden by the rear-side corrugated paperboard sheet 10. On the other hand, during conveyance of a plurality of corrugated paperboard sheets 10 between the cutter 20 and the stacker 22, a conveyance control for the corrugated paperboard sheets 10 is performed to allow a group of corrugated paperboard sheets 10 manufactured according to a certain order and a group of corrugated paperboard sheets 10 manufactured according to the next order to be conveyed with a distance therebetween. Thus, a rearmost one of the group of corrugated paperboard sheets 10 manufactured according to the certain order is not superposed with any other corrugated paperboard sheet 10, and therefore a trailing edge of the rearmost corrugated paperboard sheet 10 is exposed to outside. For the above reason, when a trailing edge of a corrugated paperboard sheet 10 is detected by the height detection sensor 70, it can be determined that all of the group of corrugated paperboard sheets 10 manufactured according to the certain order have passed through the sensing position of the height detection sensor 70, and subsequently group of corrugated paperboard sheets 10 manufactured according to the next order will start to pass through the sensing position.

Next, with reference to FIG. 22, a flow of the printing control for each of the inkjet units 50 of the printer 21 to be performed by the control device 100 in the fourth embodiment will be specifically described. FIG. 22 is a flowchart depicting a printing control processing routine in the fourth embodiment.

First of all, in step S301, the control device 100 determines use/non-use information indicative of ones of the plurality of inkjet heads 51 to be used for the printing and the remaining inkjet heads 51 to be not used for the printing, based on a content of a production order, and determines respective target width-directional positions of the plurality of inkjet heads 51. More specifically, based on a division number, a division width and the like, and under a restriction that adjacent ones of the inkjet heads 51 are kept from interference with each other (in other words, under a restriction that a distance between adjacent ones of the inkjet heads 51 is kept from becoming a minimum interspace distance or less), the control device 100 determines to, with respect to a printing target location on each of the corrugated paperboard sheet 10, select and use one of the inkjet heads 51 which is located closest thereto. In regard to each of the inkjet heads 51 determined to be used, the control device 100 determines a width-directional position corresponding to the printing target location on the corrugated paperboard sheet 10. On the other hand, in regard to each of the inkjet heads 51 determined to be not used, the control device 100 determines a preliminarily-set appropriate width-directional position.

Further, in the step S301, with respect to each of the inkjet heads 51 assigned with "use" in the use/non-use information, the control device 100 determines an initial value of a serial number to be printed (printing initial value), and determines a value (incremental value) by which the serial number is incremented, every time the printing is completed. Basically, the control device 100 uses, as this incremental value, a value of the division number (e.g., in the case where the division number is three, the incremental value is set to "3", or in the case where the division number is four, the incremental value is set to "4"). In one example, in the case where the division number is three, the number of the inkjet heads 51 to be used is three, wherein: a first one of the three inkjet heads 51 is operable to print the serial number, e.g., in the following manner: "101, 104, 107, - - - "; a second one of the remaining inkjet heads 51 located next to the first inkjet head 51 is operable to print the serial number, e.g., in the following manner: "102, 105, 108, - - - "; and the last inkjet head 51 located next to the second inkjet head 51 is operable to print the serial number, e.g., in the following manner: "103, 106, 109, - - - ".

Subsequently, in step S302, the control device 100 operates to position each of the plurality of inkjet heads 51 at the width-directional position determined in the step S301. In this case, the control device 100 controls a width-direction moving motor 54*d* of a width-direction moving mechanism 54 in each of the inkjet units 50, via a width-direction servo driving unit 104, to thereby move the inkjet unit 50 in the width direction.

Subsequently, in step S304, with respect to each of the inkjet heads 51 assigned with "use" in the use/non-use information, the control device 100 sets the initial value and the incremental value set in the step S301.

Subsequently, in step S304, based on the height detection signal from the height detection sensor 70, the control device 100 determines whether or not a leading edge of the corrugated paperboard sheet 10 has been detected. In this case, when the height detection signal rises in a stepwise manner (see FIG. 20), the control device 100 determines that the leading edge of the corrugated paperboard sheet 10 has been detected. As a result of the determination in the step S304, when the leading edge of the corrugated paperboard sheet 10 has not been detected (step S304: NO), the processing routine returns to the step S304, wherein the control device 100 performs the determination in the step S304 again. The control device 100 will repeat the determination in the step S304 until the leading edge of the corrugated paperboard sheet 10 is detected.

On the other hand, when the leading edge of the corrugated paperboard sheet 10 has been detected (step S304: YES), the processing routine proceeds to the step S305, wherein the control device 100 sets, on the corrugated paperboard sheet 10, a site away by the predetermined distance L21 from the leading edge of the corrugated paperboard sheet 10 detected by the height detection sensor 70, as the printing target site P1 where the individual identification information is to be to be printed by the inkjet head 51. Then, the control device 100 sets the printing instruction counter to a value corresponding to the length L23 (L23=L21+L22) obtained by adding the distance L22 between the sensing position of the height detection sensor 70 and the printing position of the inkjet head 51 to the predetermined distance L21 (see FIG. 21).

Subsequently, in step S306, based on the height detection signal of the height detection sensor 70 at a time when the leading edge of the corrugated paperboard sheet 10 is detected, the control device 100 positions all of the plurality of inkjet heads 51 in an up-down direction. In this case, the control device 100 controls an up-down moving motor 52*b* of an up-down moving mechanism 52 in each of the inkjet units 50, via an up-down servo driving unit 102, to thereby move the inkjet unit 50 in the up-down direction. Specifically, the control device 100 operates to position each of the plurality of inkjet heads 51 at an up-down directional position appropriate to a height position of the corrugated paperboard sheet 10 corresponding to the height detection signal. This up-down directional position appropriate to the height position of the corrugated paperboard sheet 10 means an up-down directional position where the inkjet head 51 is spaced apart from the corrugated paperboard sheet 10 by a distance which allows a distal end of the inkjet head 51 to be kept from coming into contact with the corrugated paperboard sheet 10 and allows the inkjet head 51 to adequately perform the printing with respect to the corrugated paperboard sheet 10.

Subsequently, in step S307, based on the pulse signal received from the rotating pulse generator 72 after the detection of the leading edge of the corrugated paperboard sheet 10, the control device 100 decrements the value of the printing instruction counter. Then, in step S308, the control device 100 determines whether or not the value of the printing instruction counter has become zero. As a result, when the value of the printing instruction counter has not become zero (step S308: NO), the processing routine returns to the step S307, wherein the control device 100 further decrements the value of the printing instruction counter. The control device 100 will repeat the processing in the steps S307 and S308 to decrement the value of the printing instruction counter until the value becomes zero.

On the other hand, when the value of the printing instruction counter has become zero (step S308: YES), the processing routine proceeds to the step S309. At this time, the corrugated paperboard sheet 10 is conveyed, after the leading edge of the corrugated paperboard sheet 10 has been detected, by a length corresponding to the distance L23 between the leading edge position of the printing target site P1 set on the corrugated paperboard sheet 10, and the printing position of the inkjet head 51. That is, the leading edge position of the printing target site P1 set on the corrugated paperboard sheet 10 reaches the printing position of the inkjet head 51. Thus, at this timing, the control device 100 outputs a printing instruction to the inkjet head 51 (step S309). Specifically, the control device 100 outputs, to each of the inkjet heads 51, a printing instruction including a value (printing value) to be printed on the corrugated paperboard sheet 10 as a serial number representing the individual identification information. This printing value is a value obtained by repeatedly adding the incremental value to the initial value. Every time the incremental value is added, the printing value is updated, and the updated printing value is stored in a memory or the like.

Subsequently, in step S310, the control device 100 adds the incremental value to the printing value printed in the step S309. The control device 100 updates the printing value used in the step S309, with a new printing value obtained by adding the incremental value, and stores the updated printing value in a memory or the like.

Subsequently, in step S311, based on the height detection signal from the height detection sensor 70, the control device 100 determines whether or not a leading edge of one of the remaining corrugated paperboard sheets 10 to be printed next has been detected. As a result, when the leading edge of the corrugated paperboard sheet 10 has been detected (step S311: YES), the processing routine returns to the step S305, wherein the control device 100 performs the processing in the step S305 and the subsequent steps again.

On the other hand, when the leading edge of the corrugated paperboard sheet 10 has not been detected (step S311: NO), the processing routine proceeds to the step S312, wherein, based on the height detection signal from the height detection sensor 70, the control device 100 determines whether or not a retailing edge of the corrugated paperboard sheet 10 has been detected. In this case, when the height detection signal gently lowers and then falls in a stepwise manner (see FIG. 20), the control device 100 determines that the trailing edge of the corrugated paperboard sheet 10 has been detected. As a result of the determination in the step S312, when the trailing edge of the corrugated paperboard sheet 10 has not been detected (step S312: NO), the processing routine returns to the step S311, wherein the control device 100 performs the determination in the step S311 again.

On the other hand, when the trailing edge of the corrugated paperboard sheet 10 has been detected (step S312: YES), the processing routine proceeds to the step S313. In this case, the control device 100 determines that an order change has been made, and makes a shift to production according to the next order (step S131). After this, the processing routine returns to the step S301. Thus, the control device 100 will perform the processing in the step S301 and the subsequent steps again.

(Functions/Effects)

The corrugated paperboard sheet manufacturing apparatus according to the fourth embodiment can obtain the same functions/effects as those of the corrugated paperboard sheet manufacturing apparatus according to the first embodiment (see the section "(Functions/Effects)" in the description about the first embodiment).

Particularly, in the fourth embodiment, the printer 21 is disposed at a position on the downstream side of the cutter 20 and in a region of the conveyance line where at least a part of the plurality of corrugated paperboard sheets 10 are conveyed in the partially-superposed state. In this position, a conveyance speed of the corrugated paperboard sheets 10 is lower than that in a region on the upstream side of this position, so that there is no need to increase a printing speed, i.e., there is no need to perform the printing at a high speed, following corrugated paperboard sheets conveyed at a high speed. Thus, it becomes possible to construct the printer 21 for use in the corrugated paperboard sheet manufacturing apparatus 1*c*, at a lower cost and with a simplified structure.

In the fourth embodiment, every time a leading edge of each of the plurality of corrugated paperboard sheets 10 is detected, the printing target location P1 is set on a respective one of the plurality of corrugated paperboard sheets 10, so that it becomes possible to adequately set a desired printing target location P1 in each of the plurality of corrugated paperboard sheets 10 being conveyed.

In the fourth embodiment, the printing is performed at a timing when a target corrugated paperboard sheet 10 is conveyed by a length corresponding to the distance L23 between the printing target location set on the target corrugated paperboard sheet 10 and the printing position of the printer 21, so that it becomes possible to adequately print the individual identification information on the set printing target location P1.

In the fourth embodiment, with respect to a target corrugated paperboard sheet 10 to be printed next, the individual identification information is printed at a position in a region thereof which is not superposed with a subsequent corrugated paperboard sheet 10, so that it becomes possible to adequately suppress the occurrence of a situation where the individual identification information is printed in a region across two adjacent corrugated paperboard sheets 10, or the individual identification information is printed in a front-side or rear-side corrugated paperboard sheet, instead of the target corrugated paperboard sheet 10.

In the fourth embodiment, a height position of each of the plurality of corrugated paperboard sheets 10 is sequentially detected by the height detection sensor 70, and the inkjet head 51 is moved to an up-down directional position appropriate to the detected height position, so that it becomes possible to adequately cope with the corrugated paperboard sheets 10 being conveyed in the partially superimposed state to thereby have various height positions. More specifically, it becomes possible to suppress the occurrence of a situation where a distal end of the inkjet head 51 comes into contact with one of the corrugated paperboard sheets 10, and allow the distal end of the inkjet head 51 to be spaced apart from a surface of each of the corrugated paperboard sheets 10 by an adequate distance so as to adequately perform the printing for the corrugated paperboard sheet 10.

In the fourth embodiment, when a trailing edge of a rearmost one of a group of corrugated paperboard sheets 10 is detected by the height detection sensor 70, it is determined that an order change has been made, so that it becomes possible to quickly perform control according to the order change.

In the fourth embodiment, the inkjet head 51 of the printer 21 and the height detection sensor 70 are provided with respect to the same conveyer 240 for conveying the corrugated paperboard sheets 10, so that it becomes possible to easily control the inkjet head 51 based on the detection signal of the height detection sensor 70, and accurately control the inkjet head 51 based on the detection signal of the height detection sensor 70, as compared to the case where the inkjet head 51 and the height detection sensor 70 are provided, respectively, to different conveyers.

(Modifications)

Although the fourth embodiment has been described based on an example where the present invention is applied to a down-stacker in which the inclination angle of the conveyer 204 for conveying the corrugated paperboard sheets 10 cut off by the cutter 20 is fixed (see FIG. 16), the present invention may also be applied to an up-stacker in which an inclination angle of a conveyer for conveying the corrugated paperboard sheets 10 cut off by the cutter 20 is variable.

Preferably, in the case where the present invention is applied to an up-stacker, the printer 21 is disposed around a support point (rotational support point) of the inclinable conveyer. This makes it possible to reduce a load when the conveyer is inclined, and allow the printer 21 to be located at a relatively low position even when the inclination angle of the conveyer is increased, thereby facilitating human-based inspection of the printer 21.

What is claimed is:

1. A corrugated paperboard sheet manufacturing apparatus comprising:

a single facer for bonding a corrugated medium formed with flutes and a first liner together to prepare a single-faced corrugated paperboard sheet;

a double facer for bonding a second liner to the single-faced corrugated paperboard sheet to prepare a double-faced corrugated paperboard sheet;

a slitter-scorer comprising a scorer for scoring the double-faced corrugated paperboard sheet and a slitter for slitting the double-faced corrugated paperboard sheet;

a cutter for cutting the double-faced corrugated paperboard sheet after scoring and slitting, into predetermined cut lengths in a conveyance direction of the sheet;

a stacker for stacking a plurality of double-faced corrugated paperboard sheets cut off by the cutter, in an up-down direction; and a printer disposed on a conveyance line of the corrugated paperboard sheet manufacturing apparatus, at a position on a downstream side of the double facer, and configured to print individual identification information capable of identifying respective ones of the plurality of double-faced corrugated paperboard sheets cut off by the cutter, on the double-faced corrugated paperboard sheet, in a non-contact state, wherein the corrugated paperboard sheet manufacturing apparatus further comprises a control device for controlling the printer, and wherein, every time the cutter cuts the double-faced corrugated paperboard sheet, the control device sets a printing target location on the double-faced corrugated paperboard sheet where the individual identification information is to be printed by the printer.

2. The corrugated paperboard sheet manufacturing apparatus according to claim 1, wherein the control device controls the printer to print the individual identification information on the double-faced corrugated paperboard sheet, when the double-faced corrugated paperboard sheet is conveyed after the cutting by the cutter, by a length corresponding to a distance between the printing target location set on the double-faced corrugated paperboard sheet at the time of the said cutting by the cutter and a position at which the printer performs the printing.

3. The corrugated paperboard sheet manufacturing apparatus according to claim 1, wherein the printer is disposed at a position between the slitter-scorer and the cutter.

4. The corrugated paperboard sheet manufacturing apparatus according to claim 1, wherein the printer is disposed near the scorer and/or the slitter of the slitter-scorer.

5. The corrugated paperboard sheet manufacturing apparatus according to claim 4, wherein the printer is disposed at a position between the scorer and the slitter of the slitter-scorer.

6. The corrugated paperboard sheet manufacturing apparatus according to claim 1, wherein the printer comprises a plurality of inkjet heads arranged side-by-side in a width direction relative to the conveyance direction, wherein the individual identification information includes a serial number, wherein the corrugated paperboard sheet manufacturing apparatus further comprises a control device for controlling the printer, wherein the control device selects appropriate ones of the plurality of inkjet heads based on a division number which is the number of output sheets divided from the double-faced corrugated paperboard sheet in the width direction, in order to print the individual identification information on the double-faced corrugated paperboard sheet by using each of the selected inkjet heads, and wherein, every time the individual identification information is printed on the double-faced corrugated paperboard sheet, the control device determines a number by adding a value corresponding to the division number to a number corresponding to the printed individual identification information, as new individual identification information to be subsequently printed on the double-faced corrugated paperboard sheet, in order to set the determined number to each of the selected inkjet heads.

7. A corrugated paperboard sheet manufacturing apparatus comprising:

a single facer for bonding a corrugated medium formed with flutes and a first liner together to prepare a single-faced corrugated paperboard sheet;

a double facer for bonding a second liner to the single-faced corrugated paperboard sheet to prepare a double-faced corrugated paperboard sheet;

a slitter-scorer comprising a scorer for scoring the double-faced corrugated paperboard sheet and a slitter for slitting the double-faced corrugated paperboard sheet;

a cutter for cutting the double-faced corrugated paperboard sheet after scoring and slitting, into predetermined cut lengths in a conveyance direction of the sheet, a stacker for stacking a plurality of double-faced corrugated paperboard sheets cut off by the cutter, in an up-down direction; and a printer disposed on a conveyance line of the corrugated paperboard sheet manufacturing apparatus, at a position on a downstream side of the double facer, and configured to print individual identification information capable of identifying respective ones of the plurality of double-faced corrugated paperboard sheets cut off by the cutter, on the double-faced corrugated paperboard sheet, in a non-contact state, wherein the plurality of double-faced corrugated paperboard sheets cut off by the cutter are conveyed in such a manner that adjacent ones thereof in the conveyance direction are partially superposed on each other, and then stacked on the stacker in the up-down direction, wherein the printer is disposed at a position on the downstream side of the cutter and in a region of the conveyance line where at least one of the double-faced corrugated paperboard sheets is conveyed in a state in which it has not yet been partially superposed with another, wherein the corrugated paperboard sheet manufacturing apparatus further comprises a control device for controlling the printer, and wherein, every time the cutter cuts the double-faced corrugated paperboard sheet, the control device sets a position on the double-faced corrugated sheet away by a predetermined distance from a leading edge of the double-faced corrugated paperboard sheet formed by the cutting, as a printing target location where the individual identification information is to be printed by the printer.

8. The corrugated paperboard sheet manufacturing apparatus according to claim 7, wherein the control device controls the printer to print the individual identification information on the double-faced corrugated paperboard sheet, when the double-faced corrugated paperboard sheet is conveyed by a length corresponding to the predetermined distance after the leading edge of the said double-faced corrugated paperboard sheet passes through the printing position at which the printer performs the printing just after setting the printing target location.

9. The corrugated paperboard sheet manufacturing apparatus according to claim 7, wherein the printer comprises a plurality of inkjet heads arranged side-by-side in a width direction relative to the conveyance direction, wherein the individual identification information includes a serial number, wherein the corrugated paperboard sheet manufacturing apparatus further comprises a control device for controlling the printer, wherein the control device selects appropriate ones of the plurality of inkjet heads based on a division number which is the number of output sheets divided from the double-faced corrugated paperboard sheet in the width direction, in order to print the individual identification information on the double-faced corrugated paperboard sheet by using each of the selected inkjet heads, and wherein, every time the individual identification information is printed on the double-faced corrugated paperboard sheet, the control device determines a number by adding a value corresponding to the division number to a number corresponding to the printed individual identification information, as new individual identification information to be subsequently printed on the double-faced corrugated paperboard sheet, in order to set the determined number to each of the selected inkjet heads.

10. A corrugated paperboard sheet manufacturing apparatus comprising:

a single facer for bonding a corrugated medium formed with flutes and a first liner together to prepare a single-faced corrugated paperboard sheet;

a double facer for bonding a second liner to the single-faced corrugated paperboard sheet to prepare a double-faced corrugated paperboard sheet;

a slitter-scorer comprising a scorer for scoring the double-faced corrugated paperboard sheet and a slitter for slitting the double-faced corrugated paperboard sheet;

a cutter for cutting the double-faced corrugated paperboard sheet after scoring and slitting, into predetermined cut lengths in a conveyance direction of the sheet;

a stacker for stacking a plurality of double-faced corrugated paperboard sheets cut off by the cutter, in an up-down direction; and a printer disposed on a conveyance line of the corrugated paperboard sheet manufacturing apparatus, at a position on a downstream side of the double facer, and configured to print individual identification information capable of identifying respective ones of the plurality of double-faced corrugated paperboard sheets cut off by the cutter, on the double-faced corrugated paperboard sheet, in a non-contact state, wherein the stacker stacks the plurality of double-faced corrugated paperboard sheets cut off by the cutter in the up-down direction, after being brought into a state in which adjacent ones thereof in the conveyance direction are partially superposed on each other, and wherein the printer is disposed at a position on the downstream side of the cutter and in a region of the conveyance line where at least a part of the plurality of double-faced corrugated paperboard sheets are conveyed in a partially-superposed state.

11. The corrugated paperboard sheet manufacturing apparatus according to claim 10, further comprising:

a control device for controlling the printer; and a detection device for detecting a leading edge of each of the double-faced corrugated paperboard sheets being conveyed in the partially-superposed state, wherein, every time the detection device detects the leading edge of each of the double-faced corrugated paperboard sheets, the control device sets a printing target location on the double-faced corrugated paperboard sheet where the individual identification information is to be printed by the printer.

12. The corrugated paperboard sheet manufacturing apparatus according to claim 11, wherein the control device controls the printer to print the individual identification information on the double-faced corrugated paperboard sheet, when the double-faced corrugated paperboard sheet is conveyed after a detection of the leading edge thereof by the detection device; by a length corresponding to a distance between the printing target location set on the double-faced corrugated paperboard sheet at the time of the said detection of the leading edge and a position at which the printer performs the printing.

13. The corrugated paperboard sheet manufacturing apparatus according to claim 11, wherein the printer comprises an inkjet head, and wherein the inkjet head and the detection device are provided with respect to a same conveyer for conveying the double-faced corrugated paperboard sheets.

14. The corrugated paperboard sheet manufacturing apparatus according to claim 10, wherein the printer prints the individual identification information on the double-faced corrugated paperboard sheet at a position in a region thereof where other double-faced corrugated paperboard sheets are not superposed thereon.

15. The corrugated paperboard sheet manufacturing apparatus according to claim 10, further comprising:

a control device for controlling the printer; and a detection device for detecting a height position of each of the double-faced corrugated paperboard sheets conveyed in the partially-superposed state, wherein the printer comprises an inkjet head and an up-down moving mechanism configured to move, the inkjet head in an up-down direction, and wherein the control device controls the up-down moving mechanism to move the inkjet head to an up-down position in accordance with the height position of the double-faced corrugated paperboard sheet detected by the detection device.

16. The corrugated paperboard sheet manufacturing apparatus according to claim 10, further comprising:

a control device for controlling the printer; and a detection device for detecting a trailing edge of a rearmost one of the double-faced corrugated paperboard sheets conveyed in the partially-superposed state, wherein, when the detection device detects the trailing edge of the rearmost double-faced corrugated paperboard sheet, the control device determines that an order change has been made, and then controls the printer in accordance with the order change.

17. A corrugated paperboard sheet manufacturing apparatus comprising:

a single facer for bonding a corrugated medium formed with flutes and a first liner together to prepare a single-faced corrugated paperboard sheet;

a double facer for bonding a second liner to the single-faced corrugated paperboard sheet to prepare a double-faced corrugated paperboard sheet;

a slitter-scorer comprising a scorer for scoring the double-faced corrugated paperboard sheet and a slitter for slitting the double-faced corrugated paperboard sheet;

a cutter for cutting the double-faced corrugated paperboard sheet after scoring and slitting, into predetermined cut lengths in a conveyance direction of the sheet;

a stacker for stacking a plurality of double-faced corrugated paperboard sheets cut off by the cutter, in an up-down direction; and a printer disposed on a conveyance line of the corrugated paperboard sheet manufacturing apparatus, at a position on a downstream side of the double facer, and configured to print individual identification information capable of identifying respective ones of the plurality of double-faced corrugated paperboard sheets cut off by the cutter, on the double-faced corrugated paperboard sheet, in a non-contact state, wherein the printer comprises: a plurality of inkjet heads arranged side-by-side in a width direction relative to the conveyance direction; an up-down moving mechanism configured to move each of the inkjet heads in an up-down direction; and a width-direction moving mechanism for moving each of the inkjet heads in a width direction, wherein the printer comprises two sets of the plurality of inkjet heads arranged side-by-side in the width direction, the two sets of the plurality of inkjet heads being arranged along the conveyance direction, and wherein the two sets of the plurality of inkjet heads are switchingly used according to order change.

* * * * *